US008999618B2

(12) United States Patent
Yoshida et al.

(10) Patent No.: US 8,999,618 B2
(45) Date of Patent: Apr. 7, 2015

(54) TONER SET, DEVELOPER SET, AND IMAGE FORMING APPARATUS

(71) Applicants: Ryuuta Yoshida, Shizuoka (JP); Satoshi Ogawa, Nara (JP); Masaki Watanabe, Shizuoka (JP); Hyo Shu, Shizuoka (JP); Naohiro Watanabe, Shizuoka (JP)

(72) Inventors: Ryuuta Yoshida, Shizuoka (JP); Satoshi Ogawa, Nara (JP); Masaki Watanabe, Shizuoka (JP); Hyo Shu, Shizuoka (JP); Naohiro Watanabe, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 15 days.

(21) Appl. No.: 13/897,658

(22) Filed: May 20, 2013

(65) Prior Publication Data

US 2013/0316280 A1 Nov. 28, 2013

(30) Foreign Application Priority Data

May 25, 2012 (JP) ..... 2012-119419

(51) Int. Cl.

| | |
|---|---|
| ***G03G 9/087*** | (2006.01) |
| ***G03G 15/01*** | (2006.01) |
| ***G03G 8/00*** | (2006.01) |
| ***G03G 9/08*** | (2006.01) |
| ***G03G 9/09*** | (2006.01) |

(52) U.S. Cl.

CPC ..... *G03G 15/01* (2013.01); *G03G 8/00* (2013.01); *G03G 9/0819* (2013.01); *G03G 9/0821* (2013.01); *G03G 9/0827* (2013.01); *G03G 9/08755* (2013.01); *G03G 9/08793* (2013.01); *G03G 9/08795* (2013.01); *G03G 9/08797* (2013.01); *G03G 9/09* (2013.01)

(58) Field of Classification Search

CPC ..... G03G 9/08755; G03G 9/08795; G03G 9/0827; G03G 9/08797; G03G 9/0821; G03G 9/0819; G03G 9/08793

USPC ..... 430/109.4, 111.4, 45.51, 126.1

See application file for complete search history.

(56) References Cited

U.S. PATENT DOCUMENTS

| | | | | |
|---|---|---|---|---|
| 6,051,350 | A * | 4/2000 | Inaba et al. | 430/45.54 |
| 7,504,188 | B2 | 3/2009 | Yamada et al. | |
| 7,531,279 | B2 | 5/2009 | Watanabe et al. | |
| 8,007,976 | B2 | 8/2011 | Sugiura et al. | |
| 2006/0093943 | A1 | 5/2006 | Shu et al. | |
| 2006/0160011 | A1 | 7/2006 | Inoue et al. | |
| 2006/0210903 | A1 | 9/2006 | Ohki et al. | |
| 2006/0240349 | A1 | 10/2006 | Watanabe et al. | |
| 2006/0240350 | A1 | 10/2006 | Shu et al. | |
| 2007/0031752 | A1 | 2/2007 | Watanabe et al. | |
| 2007/0042284 | A1 | 2/2007 | Takada et al. | |
| 2007/0048653 | A1 | 3/2007 | Ide | |
| 2007/0059626 | A1 | 3/2007 | Inoue et al. | |
| 2007/0141506 | A1 | 6/2007 | Inoue et al. | |
| 2007/0218392 | A1 | 9/2007 | Yamada et al. | |
| 2008/0014525 | A1* | 1/2008 | Sanders et al. | 430/113 |
| 2008/0070144 | A1 | 3/2008 | Nagatomo et al. | |
| 2008/0318144 | A1 | 12/2008 | Watanabe et al. | |
| 2009/0074467 | A1 | 3/2009 | Seshita et al. | |
| 2009/0092917 | A1 | 4/2009 | Sugimoto et al. | |
| 2009/0104555 | A1 | 4/2009 | Wakamatsu et al. | |
| 2009/0117480 | A1 | 5/2009 | Yamada et al. | |
| 2009/0123857 | A1 | 5/2009 | Shu et al. | |
| 2009/0214973 | A1 | 8/2009 | Sugimoto et al. | |
| 2009/0233218 | A1 | 9/2009 | Ogawa | |
| 2009/0325099 | A1 | 12/2009 | Watanabe et al. | |
| 2010/0035170 | A1 | 2/2010 | Sugimoto et al. | |
| 2010/0129748 | A1 | 5/2010 | Inoue et al. | |
| 2010/0183966 | A1 | 7/2010 | Kadokura et al. | |
| 2010/0227265 | A1 | 9/2010 | Matsumoto et al. | |
| 2011/0002719 | A1 | 1/2011 | Shu et al. | |
| 2011/0076607 | A1 | 3/2011 | Sugimoto et al. | |
| 2011/0223530 | A1 | 9/2011 | Inoue et al. | |
| 2011/0262853 | A1 | 10/2011 | Watanabe et al. | |
| 2012/0064447 | A1 | 3/2012 | Hozumi et al. | |
| 2012/0295193 | A1 | 11/2012 | Hanatani et al. | |
| 2013/0011779 | A1 | 1/2013 | Yamashita et al. | |

FOREIGN PATENT DOCUMENTS

| | | | |
|---|---|---|---|
| EP | 0 974 871 | A1 | 1/2000 |
| JP | 04-278967 | | 10/1992 |
| JP | 04-338984 | | 11/1992 |
| JP | 04-362960 | | 12/1992 |
| JP | 05-158364 | | 6/1993 |
| JP | 07248662 | A * | 9/1995 |
| JP | 08-220821 | | 8/1996 |
| JP | 08220821 | A * | 8/1996 |
| JP | 09-200551 | | 7/1997 |
| JP | 2000-039738 | | 2/2000 |
| JP | 2001175022 | A * | 6/2001 |

(Continued)

OTHER PUBLICATIONS

Borsenberger, Paul M. and David Weiss. Organic Photoreceptors for Imaging Systems. New York: Marcel-Dekker, Inc. (1993) pp. 6-17.*

English language machine translation of JP 07-248662 (Sep. 1995).*

English language machine translation of JP 2003-07949 (Jul. 2003).*

English language machine translation of JP 2002-055488 (Feb. 2002).*

English language machine translation of JP 08-220821 (Aug. 1996).*

English language machine translation of JP 2001-175022 (Jun. 2001).*

Extended Search Report issued Aug. 29, 2013 in European Patent Application No. 13169007.5.

*Primary Examiner* — Christopher Rodee

(74) *Attorney, Agent, or Firm* — Oblon, McClelland, Maier & Neustadt, L.L.P.

(57) ABSTRACT

A toner set, including: at least one chromatic toner containing a colorant; and a transparent toner containing no colorant, wherein the chromatic toner and the transparent toner each include a releasing agent and a binder resin, and wherein an amount of a tetrahydrofuran insoluble matter in the transparent toner is smaller than an amount of a tetrahydrofuran insoluble matter in the chromatic toner.

9 Claims, 2 Drawing Sheets

(56) References Cited

FOREIGN PATENT DOCUMENTS

| | | | |
|---|---|---|---|
| JP | 2002055488 A | * | 2/2002 |
| JP | 2002-108018 | | 4/2002 |
| JP | 2002-214831 | | 7/2002 |
| JP | 2003-167384 | | 6/2003 |
| JP | 2003207949 A | * | 7/2003 |
| JP | 2006-276044 | | 10/2006 |
| JP | 2007-148085 | | 6/2007 |
| JP | 2009-109926 | | 5/2009 |

* cited by examiner

TONER SET, DEVELOPER SET, AND IMAGE FORMING APPARATUS

BACKGROUND OF THE INVENTION

1. Field of the Invention

The present invention relates to: a toner set containing a chromatic toner and a transparent toner; a developer set using the toner set; and an image forming apparatus.

2. Description of the Related Art

In recent years, there is an increased demand for image forming apparatuses that can save energy for fixing toner and respond to high-speed processing, and toners themselves are required to melt at low temperatures. There is also an increased demand for attaining high-image quality. For high-quality image formation such as formation of photo images, gloss is imparted to a surface of recording media to provide vivid high-gloss images. For example, proposed are a method in which a transparent toner is applied to a non-image portion without a chromatic toner to thereby reduce the difference in gloss between an image portion with a chromatic toner and the non-image portion; and a method in which a transparent toner is applied to the entire surface of a recording medium (see Japanese Patent Application Laid-Open (JP-A) Nos. 04-278967, 04-362960 and 09-200551). Also, proposed is an apparatus including a fixing unit configured to heat a recording medium having a chromatic toner image and a transparent toner image for melting, followed by cooling and peeling off, to thereby form a high-gloss image on the recording medium (see JP-A No. 05-158364). According to these proposals, it is possible to reduce the difference in gloss over the entire surface of a recording medium to form an image having a uniform gloss.

In the field of printing, in order to control the gloss of a recording medium, UV varnish printing, varnishing or polypropylene (PP) laminating is generally employed to perform so-called spot varnish printing, which increases the gloss of a specific portion of a recording medium.

In such spot varnish printing, a plate for partially increasing the gloss after usual color printing is formed and coated with, for example, UV varnish for printing. A portion that has been subjected to the spot varnish printing can have a high gloss like a photo image. Meanwhile, the other portion that has not been subjected to the spot varnish printing has a low gloss. In this manner, the difference in gloss on the resultant image becomes large, so that these portions can be distinguished from each other to a more extent than in usual printing. However, the spot varnish printing in offset printing requires a special plate. In addition, offset printing cannot respond to variable data and thus requires a printing lot number more than a certain number. If electrophotographic image forming apparatuses such as laser printers and dry-process electrostatic copiers can realize a function of spot varnish printing, a plate for printing is not necessary, and also it is possible to respond to variable data.

Proposed methods for forming portions having different glosses on the same recording medium by an electrophotography process include: a method of controlling gloss by adjusting the number average molecular weight of a resin used in a toner (see JP-A No. 08-220821); a method in which a chromatic toner image is fixed and a transparent toner image is formed thereon, and then the fixing temperature is reduced to reduce gloss (see JP-A No. 2009-109926); and a method in which a first printing operation is performed on a gloss portion, followed by fixing, and a second printing operation is performed on a non-gloss portion, followed by fixing (see JP-A No. 04-338984). These proposals can form portions having different glosses on the same recording medium, but have not realized yet a high-gloss image comparable to a photo image obtained by the spot varnish printing.

As described above, various methods of controlling gloss on recording media using a transparent toner have been proposed. For example, JP-A No. 08-220821 describes a transparent toner containing a polyester resin having a number average molecular weight of about 3,500, and a chromatic toner containing a polyester resin having a number average molecular weight of about 10,000, where the melting point of the transparent toner is lower than that of chromatic toner, which improves smoothness and partially increases glossiness of the transparent toner portion. Meanwhile, since the transparent toner is formed on the uppermost layer of an image and comes into direct contact with a fixing unit, the transparent toner is required to have higher hot offset resistance than the chromatic toner. In addition, a layer of the toner becomes thick since the transparent toner layer is formed on the chromatic toner image. Moreover, unless the chromatic toner has high cold offset property, the resultant image formed from the combination of the transparent toner having a low melting point and the chromatic toner having a high melting point lacks stability. Therefore, in order to form a high-gloss image comparable to the aforementioned photo image, only adjusting the number average molecular weights of the resins used in the transparent and chromatic toners is not sufficient.

In the image forming method described in JP-A No. 2009-109926, the maximum melt viscosity of toner in the fixing nip in second image formation is set to be higher than that of toner in the fixing nip in first image formation. Thus, a transparent toner image formed in the second image formation does not sufficiently melt to result in reduction of gloss, making it impossible to form a high-gloss image comparable to a photo image.

JP-A No. 04-338984 describes that styrene-acryl copolymers and thermosetting resins and thermoplastic resins such as polyester resins can be used as a resin of a transparent toner, but does not disclose a constitution of toner for obtaining gloss.

Therefore, demand has arisen for provision or a toner set containing both a transparent toner and a chromatic toner, and being excellent in hot offset resistance and capable of attaining high glossiness and sufficient fixability at the same time; and an image forming apparatus capable of forming a color image using the toner set so as to make an intended region of the color image have different gloss from the other region thereof.

SUMMARY OF THE INVENTION

The present invention aims to provide a toner set containing both a transparent toner and a chromatic toner, and being excellent in hot offset resistance and capable of attaining high glossiness and sufficient fixability at the same time.

A toner set of the present invention as a means for solving the above problems includes:

at least one chromatic toner containing a colorant; and a transparent toner containing no colorant, wherein the chromatic toner and the transparent toner each include a releasing agent and a binder resin, and wherein an amount of a tetrahydrofuran insoluble matter in the transparent toner is smaller than an amount of a tetrahydrofuran insoluble matter in the chromatic toner.

The present invention can provide a toner set containing both a transparent toner and a chromatic toner, and being excellent in hot offset resistance and capable of attaining high glossiness and sufficient fixability at the same time. The toner set can solve the above existing problems and achieve the above object.

Figure 1:
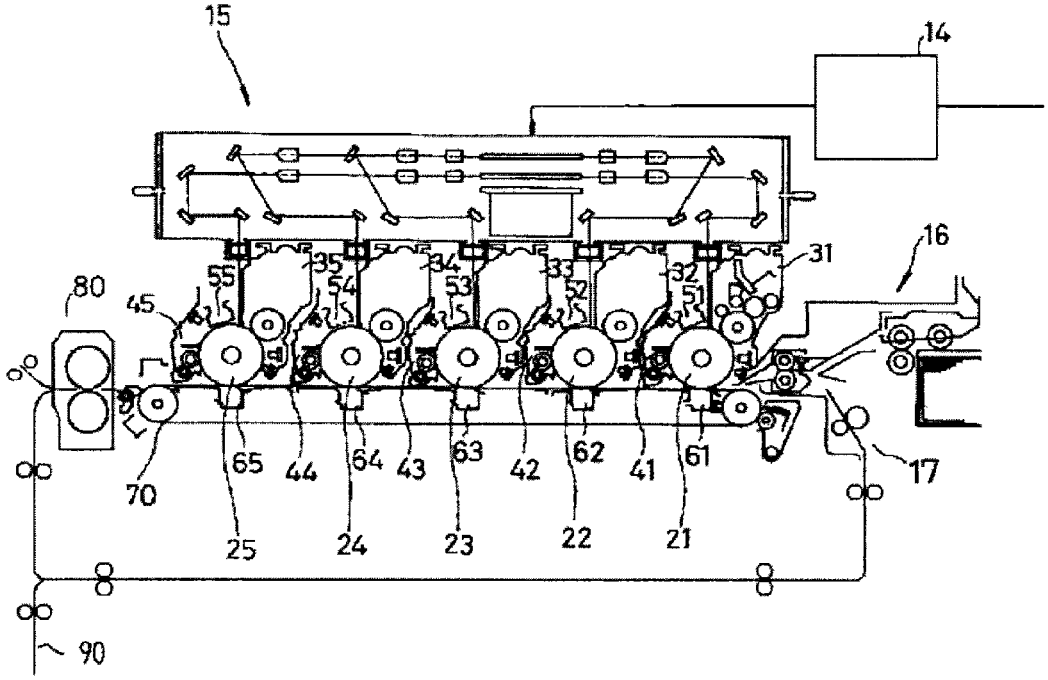
FIG. 1 is a schematic view of one example of an image forming apparatus of the present invention.

DETAILED DESCRIPTION OF THE INVENTION (Toner Set)

A toner set of the present invention contains a chromatic toner and a transparent toner.

When a toner set is improved for increasing the gloss of an image, the chromatic toner and the transparent toner of the toner set are generally reduced in viscoelasticity. When the viscoelasticity of each toner of the toner set is reduced, the surface of an image is improved in smoothness to suppress scattering of light, thereby improving glossiness. In addition, the toners can be fixed at low temperatures to attain improved energy saving. However, when each toner of the toner set is simply reduced in viscoelasticity, anchoring effects between each molten toner of the toner set and recording media such as paper are weakened, so that there is a problem of the occurrence of hot offset.

Under such circumstances, the present inventors conducted extensive studies to solve the above problems, and have found that it is possible to provide a toner set excellent in hot offset resistance and capable of attaining high glossiness and sufficient fixability at the same time by incorporating, into each toner of the toner set, a gel component in an appropriate amount which is insoluble to tetrahydrofuran (THF) due to a crosslinked structure present in a resin, and also by adjusting the amount of the THF insoluble matter in each of the transparent toner and the chromatic toner of the toner set so as to be in an appropriate range. The present inventors also found that the above toner set can provide a great difference in glossiness between an image portion formed of the chromatic toner and a high-gloss image portion where the transparent toner has additionally been fixed on the image portion formed of the chromatic toner.

In the toner set of the present invention containing the chromatic toner and the transparent toner, an amount of a tetrahydrofuran (THF) insoluble matter in the transparent toner is smaller than an amount of a tetrahydrofuran (THF) insoluble matter in the chromatic toner. When the amount of the THF insoluble matter in the transparent toner is smaller than the amount of the THF insoluble matter in the chromatic toner, the toner set is excellent in hot offset resistance, and high glossiness and sufficient fixability are easy to attain at the same time. Whereas when the amount of the THF insoluble matter in the transparent toner is larger than the amount of the THF insoluble matter in the chromatic toner, the average glossiness of the formed image is low, so that it may not be possible to provide a sufficient difference in glossiness between the image portion formed of the chromatic toner and the high-gloss image portion where the transparent toner has additionally been fixed on the image portion formed of the chromatic toner.

The amount of the tetrahydrofuran insoluble matter in the chromatic toner is preferably 14% by mass or more but 23% by mass or less, more preferably 16% by mass to 19% by mass.

The amount of the tetrahydrofuran insoluble matter in the transparent toner is preferably 5% by mass or more but less than 14% by mass, more preferably 6% by mass to 10% by mass.

When the amount of the THF insoluble matter in the chromatic toner is less than 14% by mass or the amount of the THF insoluble matter in the transparent toner is less than 5% by mass, the hot offset resistance of the toner set may be degraded.

When the amount of the THF insoluble matter in the chromatic toner is more than 23% by mass, the low-temperature fixability of the toner may be degraded. Meanwhile, the transparent toner can contain the THF insoluble matter more than in the chromatic toner without being degraded in low-temperature fixability. However, when the amount of the THF insoluble matter in the transparent toner is 14% by mass or more, the gloss may be degraded.

A ratio of the amount of the tetrahydrofuran insoluble matter in the transparent toner to the amount of the tetrahydrofuran insoluble matter in the chromatic toner is preferably 0.65 or less, more preferably 0.55 or less. When the above ratio is more than 0.65, it may not be possible to provide a sufficient difference in glossiness between the image portion formed of the chromatic toner and the high-gloss image portion where the transparent toner has additionally been fixed on the image portion formed of the chromatic toner.

Here, the amount of the THF insoluble matter of each of the transparent toner and the chromatic toner of the toner set can be calculated from the residual toner remaining after each toner has been extracted with a Soxhlet extractor for 8 hours using tetrahydrofuran (THF) as an extraction solvent. It can specifically be measured in the following manner.

<<Amount of Tetrahydrofuran (THF) Insoluble Matter>>

Each (3 g) of the transparent toner and the chromatic toner of the toner set is weighed and defined as A (g). Next, each toner is charged into cylindrical filter paper (inner diameter: 24 mm) having a known mass, and the cylindrical filter paper is set to an extraction tube. Then, tetrahydrofuran (THF) (200 mL) is added to a flask. The flask equipped with a condenser is immersed in a mantle heater, and the THF is refluxed at 60° C. The THF is dropped to each toner through the condenser, and THF soluble matter of the toner is extracted in the flask. After extraction at 60° C. for 8 hours, the THF serving as a liquid for extraction is evaporated under reduced pressure, and the residue remaining on the cylindrical filter paper (THF insoluble matter) is weighed. The obtained value is defined as B (g). The above-described measurement for the values A and B is performed 5 times in total. Each of the values A and B is an average of 5 values obtained in the measurements performed 5 times.

The thus-obtained A and B are assigned to the following formula to calculate an amount of THF insoluble matter (% by mass).

$$\text{Amount of THF insoluble matter(\% by mass)}=(B/A)\times 100$$

The tetrahydrofuran (THF) insoluble matter contained in each of the transparent toner and the chromatic toner of the toner set is mainly a part having a network structure formed by crosslinking in the resin (gel component) and has high elasticity.

—Control of Amount of THF Insoluble Matter in Toner Set—

The amount of the THF insoluble matter of the transparent toner and the chromatic toner of the toner set can be controlled by changing the amount of the resin containing the gel component.

A method for incorporating the gel component into each of the transparent toner and the chromatic toner of the toner set is not particularly limited and may be appropriately selected depending on the intended purpose. Examples thereof include: a method of using a resin containing a gel component as a binder resin; and a method including forming toner particles from toner materials containing a binder resin precursor having in the molecule thereof a functional group capable of performing elongation or crosslinking reaction, and a compound capable of reacting with the binder resin precursor; and heating or aging the obtained toner particles to allow the reaction to proceed, to thereby form a gel component in each toner particle.

The chromatic toner in the toner set contains a colorant and is a yellow toner, a magenta toner, a cyan toner, a black toner, or any combination thereof.

The transparent toner in the toner set is a toner containing no colorant.

The chromatic toner and the transparent toner each include at least a releasing agent and a binder resin; and, if necessary, further include other ingredients.

<Binder Resin>

The binder resin contains a non-crystalline resin and a crystalline resin.

<<Non-Crystalline Resin>>

The non-crystalline resin is preferably a non-crystalline polyester resin since the obtained toner is improved in low-temperature fixability and glossiness when used in full-color image forming apparatuses.

The non-crystalline polyester resin preferably contains a polyester resin that has not been modified (i.e., an unmodified polyester resin) and a modified polyester resin.

—Unmodified Polyester Resin—

The unmodified polyester resin is not particularly limited and may be appropriately selected depending on the intended purpose, and can be obtained through polycondensation reaction between an alcohol component and an acid component.

Examples of the alcohol component include alkylene glycols (e.g., ethylene glycol and 1,6-hexanediol), bisphenols (e.g., bisphenol A and bisphenol S), alkylene oxide adducts of bisphenols (e.g., bisphenol A ethylene oxide 2 mol adducts and bisphenol A propylene oxide 2 mol adducts), trihydric or higher hydric polyalcohols (e.g., 1,1,1-trimethylolpropane and pentaerythritol). These may be used alone or in combination.

Examples of the acid component include polycarboxylic acids. The polycarboxylic acid is not particularly limited and may be appropriately selected depending on the intended purpose. Examples thereof include: alkylene dicarboxylic acids (e.g., succinic acid, adipic acid and sebacic acid); aromatic dicarboxylic acids (e.g., terephthalic acid and isophthalic acid); and trivalent or higher-valent polycarboxylic acids (e.g., C9-C20 aromatic polycarboxylic acids such as trimellitic acid and pyromellitic acid). These may be used alone or in combination.

The weight average molecular weight (Mw) of the unmodified polyester resin which is measured by subjecting its tetrahydrofuran (THF) soluble matter to gel permeation chromatography (GPC) is not particularly limited and may be appropriately selected depending on the intended purpose, but is preferably 1,000 to 20,000, more preferably 2,000 to 10,000.

The number average molecular weight (Mn) of the unmodified polyester resin which is measured by subjecting its tetrahydrofuran (THF) soluble matter to gel permeation chromatography (GPC) is not particularly limited and may be appropriately selected depending on the intended purpose, but is preferably 500 to 6,000, more preferably 1,000 to 5,000.

The acid value of the unmodified polyester resin is preferably 1 mgKOH/g to 50 mgKOH/g, more preferably 10 mgKOH/g to 30 mgKOH/g. Accordingly, the acid value is 1 mgKOH/g or greater, therefore, the toner tends to be negatively charged, and moreover, an affinity between paper and the toner improves during fixing to paper, which can increase low temperature fixing ability of the toner. However, when the acid value is greater than 50 mgKOH/g, charge stability, especially charge stability to environmental variation, may lower.

Notably, the acid value can be measured according to the measurement method described in JIS K0070-1992.

—Modified Polyester Resin—

The modified polyester resin can provide each toner of the toner set with an appropriate extent of crosslinked structures. The modified polyester resin is not particularly limited and may be appropriately selected depending on the intended purpose, so long as it is a resin having a urethane bond and/or a urea bond. The modified polyester resin is preferably resins obtained through elongating reaction and/or crosslinking reaction between an active hydrogen group-containing compound and a binder resin precursor having a functional group reactive with the active hydrogen group-containing compound (hereinafter may be referred to as "prepolymer").

The prepolymer is not particularly limited and may be appropriately selected depending on the intended purpose so long as it is a polyester resin containing at least a functional group reactive with the active hydrogen group-containing compound.

The functional group in the prepolymer reactive with the active hydrogen group-containing compound is not particularly limited and may be appropriately selected from known substituents. Examples of the substituent include an isocyanate group, an epoxy group, a carboxylic acid group and an acid chloride group. These may be contained alone or in combination. Among them, an isocyanate group is preferred.

The method for synthesizing the prepolymer is not particularly limited and may be appropriately selected depending on the intended purpose. For producing an isocyanate group-containing prepolymer, for example, the following method can be employed. Specifically, a polyol and a polycarboxylic acid are heated to a temperature of 150° C. to 280° C. in the presence of a known esterification catalyst (e.g., titanium tetrabutoxide or dibutyltin oxide). Subsequently, the formed water is removed under reduced pressure if necessary, to prepare a hydroxyl group-containing polyester. Thereafter, the thus-prepared hydroxyl group-containing polyester is reacted with a polyisocyanate at a temperature of 40° C. to 140° C. to prepare the isocyanate group-containing prepolymer.

The polyol is not particularly limited and may be appropriately selected depending on the intended purpose. Examples thereof include: diols such as alkylene glycols (e.g., ethylene glycol, 1,2-propylene glycol, 1,3-propylene glycol, 1,4-butanediol and 1,6-hexanediol), alkylene ether glycols (e.g., diethylene glycol, triethylene glycol, dipropylene glycol, polyethylene glycol, polypropylene glycol and polytetramethylene ether glycol), alicyclic diols (e.g., 1,4-cyclohexane dimethanol and hydrogenated bisphenol A), bisphenols (e.g., bisphenol A, bisphenol F and bisphenol S), adducts of the above-listed alicyclic diols with alkylene oxides (e.g., ethylene oxide, propylene oxide and butylene oxide); adducts of the above-listed bisphenols with alkylene oxides (e.g., ethylene oxide, propylene oxide and butylene oxide); trihydric or higher polyols such as polyhydric aliphatic alcohols (e.g., glycerin, trimethylolethane, trimethylolpropane, pentaerythritol and sorbitol), trihydric or higher phenols (e.g., phenol novolak and cresol novolak) and adducts of trihydric or higher polyphenols with alkylene oxides; and mixtures of diols and trihydric or higher polyols. These may be used alone or in combination.

Among them, the polyol is preferably the diol alone or mixtures of the diol and a small amount of the trihydric or higher polyol. The diol is preferably C2-C12 alkylene glycols or adducts of bisphenols with alkylene oxide (e.g., bisphenol A ethylene oxide 2 mol adducts, bisphenol A propylene oxide 2 mol adducts and bisphenol A propylene oxide 3 mol adducts).

The polycarboxylic acid is not particularly limited and may be appropriately selected depending on the intended purpose. Examples thereof include: alkylene dicarboxylic acids (e.g., succinic acid, adipic acid and sebacic acid); alkenylene dicarboxylic acids (e.g., maleic acid and fumaric acid); aromatic dicarboxylic acids (e.g., terephthalic acid, isophthalic acid, and naphthalene dicarboxylic acid); and trivalent or higher polycarboxylic acids (e.g., C9-C20 aromatic polycarboxylic acids such as trimellitic acid and pyromellitic acid). These may be used alone or in combination.

Among them, the polycarboxylic acid is preferably C4-C20 alkenylene dicarboxylic acids or C8-C20 aromatic dicarboxylic acids.

Notably, instead of the polycarboxylic acids, anhydrides or lower alkyl esters (e.g., methyl esters, ethyl esters and isopropyl esters) of the polycarboxylic acids may be used.

The mixing ratio of the polyol and the polycarboxylic acid is not particularly limited and may be appropriately selected depending on the intended purpose. The mixing ratio thereof is preferably 2/1 to 1/1, more preferably 1.5/1 to 1/1, particularly preferably 1.3/1 to 1.02/1, in terms of the equivalent ratio [OH]/[COOH] of the hydroxyl group [OH] of the polyol to the carboxyl group [COOH] of the polycarboxylic acid.

The polyisocyanate is not particularly limited and may be appropriately selected depending on the intended purpose. Examples thereof include: aliphatic polyisocyanates (e.g., tetramethylene diisocyanate, hexamethylene diisocyanate, 2,6-diisocyanatomethylcaproate, octamethylene diisocyanate, decamethylene diisocyanate, dodecamethylene diisocyanate, tetradecamethylene diisocyanate, trimethylhexane diisocyanate and tetramethylhexane diisocyanate); alicyclic polyisocyanates (e.g., isophoron diisocyanate and cyclohexylmethane diisocyanate); aromatic diisocyanates (e.g., tolylene diisocyanate and diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate and diphenylether-4,4'-diisocyanate); aromatic aliphatic diisocyanates (e.g., α,α,α,α'-tetramethylxylylene diisocyanate); isocyanurates (e.g., tris-isocyanatoalkyl-isocyanurate and triisocyanatocycloalkyl-isocyanurate); phenol derivatives thereof; and blocked products thereof with, for example, oxime or caprolactam. These may be used alone or in combination.

When reacting the polyisocyanate with the hydroxyl group-containing polyester, a solvent may be used if necessary. The solvent usable is not particularly limited and may be appropriately selected depending on the intended purpose. Examples thereof include solvents inert to isocyanates such as aromatic solvents (e.g., toluene and xylene); ketones (e.g., acetone, methyl ethyl ketone and methyl isobutyl ketone); esters (e.g., ethyl acetate); amides (e.g., dimethylformamide and dimethylacetamide); and ethers (e.g., tetrahydrofuran). These may be used alone or in combination.

The mixing ratio of the polyisocyanate and the hydroxyl group-containing polyester is not particularly limited and may be appropriately selected depending on the intended purpose. The mixing ratio thereof is preferably 5/1 to 1/1, more preferably 4/1 to 1.2/1, particularly preferably 2.5/1 to 1.5/1, in terms of the equivalent ratio [NCO]/[OH] of the isocyanate group [NCO] of the polyisocyanate to the hydroxyl group [OH] of the hydroxyl group-containing polyester. When the equivalent ratio [NCO]/[OH] is more than 5/1, the remaining polyisocyanate compound may adversely affect the chargeability of the formed toner.

——Active Hydrogen Group-Containing Compound——

The active hydrogen group-containing compound acts, in an aqueous medium, as an elongating agent or crosslinking agent at the time of the elongating reaction or crosslinking reaction of the prepolymer.

The active hydrogen group is not particularly limited and may be appropriately selected depending on the intended purpose. Examples thereof include a hydroxyl group (e.g., an alcoholic hydroxyl group or a phenolic hydroxyl group), an amino group, a carboxyl group and a mercapto group. These may be contained alone or in combination.

The active hydrogen group-containing compound is not particularly limited and may be appropriately selected depending on the intended purpose, so long as it contains an active hydrogen group. Examples thereof include water. In cases where the prepolymer is an isocyanate group-containing prepolymer described below, amines are preferably used from the viewpoint of increasing the molecular weight of the reaction product.

The amines serving as the active hydrogen group-containing compound are not particularly limited and may be appropriately selected depending on the intended purpose. Examples thereof include diamines, trivalent or higher polyamines, amino alcohols, amino mercaptans, amino acids, and compounds obtained by blocking an amino group of these amines. Examples of the diamines include aromatic diamines (e.g., phenylenediamine, diethyltoluenediamine and 4,4'-diaminodiphenylmethane); alicyclic diamines (e.g., 4,4'-diamino-3,3' dimethyldicyclohexylmethane, diaminecyclohexane and isophoronediamine); and aliphatic diamines (e.g., ethylenediamine, tetramethylenediamine and hexamethylenediamine). Examples of the trivalent or higher polyamines include diethylenetriamine and triethylenetetramine. Examples of the amino alcohols include ethanolamine and hydroxyethylaniline. Examples of the amino mercaptans include aminoethyl mercaptan and aminopropyl mercaptan. Examples of the amino acids include aminopropionic acid and aminocaproic acid. Examples of the compounds obtained by blocking an amino group of the above amines include oxazoline compounds and ketimine compounds obtained from any of the above amines (i.e., diamines, trivalent or higher polyamines, amino alcohols, amino mercaptans and amino acids) and ketones (e.g., acetone, methyl ethyl ketone and methyl isobutyl ketone). These may be used alone or in combination.

Among them, the amines are particularly preferably diamines or mixtures of diamines and a small amount of trivalent or higher polyamines.

The active hydrogen group-containing compound and the prepolymer are allowed to undergo the elongating and/or crosslinking reaction in an aqueous medium, to thereby obtain the modified polyester resin.

The elongating and/or crosslinking reaction may be terminated using a reaction terminator such as monoamines (e.g., diethylamine, dibutylamine, butylamine or laurylamine) or compounds obtained by blocking monoamines (e.g., ketimine compounds).

In the synthesis of the modified polyester resin, the mixing ratio of the isocyanate group-containing prepolymer serving as the prepolymer and the amines serving as the active hydrogen group-containing compound is not particularly limited and may be appropriately selected depending on the intended purpose. The mixing ratio thereof is preferably 1/2 to 2/1, more preferably 1/1.5 to 1.5/1, particularly preferably 1/1.2 to 1.2/1, in terms of the equivalent ratio [NCO]/[NHx] of the isocyanate group [NCO] of the isocyanate group-containing prepolymer to the amino group [NHx] of the amines.

The amount of the modified polyester resin contained in the transparent toner of the toner set is preferably 15% by mass or less, more preferably 1% by mass to 10% by mass. When the amount is more than 15% by mass, THF insoluble matter contained in the transparent toner is increased, so that a satisfactory difference in glossiness may not be achieved between the chromatic toner and the transparent toner.

The amount of the modified polyester resin contained in the chromatic toner of the toner set is preferably 5% by mass or more, more preferably 5% by mass to 30% by mass, further preferably 10% by mass to 20% by mass. When the amount is less than 5% by mass, THF insoluble matter contained in the transparent toner is decreased and thus the chromatic toner may have high glossiness, so that a satisfactory difference in glossiness may not be achieved between the chromatic toner and the transparent toner.

<<Crystalline Resin>>

The toner set of the present invention contains the crystalline resin and thus can be improved in low-temperature fixability and also in glossiness.

The crystalline structure of the crystalline resin tends to degrade near its melting point, so that the crystalline resin drastically decreases in viscosity. With this property, it can provide the toner with good low-temperature fixability while keeping heat resistance storage stability high.

The crystalline resin is preferably a crystalline polyester resin from the viewpoint of improvements in low-temperature fixability.

The crystallinity and the molecular structure of the crystalline polyester resin may be confirmed, for example, by NMR, differential scanning calorimetry (DSC), X-ray diffraction, GC/MS, LC/MS, and measurement of infrared (IR) absorption spectrum. For example, in its infrared (IR) absorption spectrum, a polyester resin that exhibits absorption at wavelengths of 965±10 $cm^{-1}$ and 990±10 $cm^{-1}$, which is based on an out-of-plane bending vibration (δCH) of the olefin, is preferred. In this case, it is possible to regard such a polyester resin that exhibits the above absorption as being crystalline.

The crystalline polyester resin can be synthesized through, for example, polycondensation reaction between an alcohol component and an acid component.

The alcohol component is not particularly limited and may be appropriately selected depending on the intended purpose. Suitable examples thereof include diol compounds.

The number of carbon atoms of the diol compounds is preferably 2 to 8, more preferably 2 to 6. Examples of such diol compounds include 1,4-butanediol, ethylene glycol, 1,2-propylene glycol, 1,3-propylene glycol or derivatives thereof. These may be used alone or in combination. Among them, 1,4-butanediol and 1,6-hexanediol are particularly preferred.

The amount of the diol compounds is preferably 80 mol % or more in the alcohol component, more preferably 85 mol % to 100 mol % in the alcohol component.

When the amount of the diol compounds in the alcohol component is less than 80 mol %, production efficiency may be degraded.

The acid component is not particularly limited and may be appropriately selected depending on the intended purpose. Examples thereof include carboxylic acids having carbon-carbon double bonds, dicarboxylic acid compounds and polyvalent carboxylic acid compounds, with dicarboxylic acid compounds being preferred.

The number of carbon atoms of the dicarboxylic acid compounds is preferably 2 to 8, more preferably 2 to 6. Examples of such dicarboxylic acid compounds include oxalic acid, maleic acid, fumaric acid, succinic acid, adipic acid, or anhydrides of these acids, or C1-C3 alkyl esters thereof. These may be used alone or in combination. Among them, fumaric acid is particularly preferred.

The amount of the dicarboxylic acid compounds is preferably 80 mol % or more in the acid component, more preferably 85 mol % to 100 mol % in the acid component. When the amount of the dicarboxylic acid compounds in the acid component is less than 80 mol %, production efficiency may be degraded.

Examples of the polyvalent carboxylic acid compounds include trimellitic acid, pyromellitic acid, or anhydrides of these acids, or C1-C3 alkyl esters these acids.

The polycondensation reaction is not particularly limited and may be appropriately selected depending on the intended purpose. The polycondensation reaction can be performed by allowing the alcohol and acid components to react at 120° C. to 230° C. in an inert gas atmosphere using, for example, an esterification catalyst and a polymerization inhibitor.

In the polycondensation reaction, all of the monomers may be charged at one time in order to improve the strength of the obtained crystalline polyester resin. Also, in order to reduce the amount of low-molecular-weight components, divalent monomers may be allowed to react and then trivalent or higher monomers may be added to the reaction mixture and allowed to react. Furthermore, in order to promote the reaction, the reaction system may be reduced in pressure in the later half period of the polycondensation reaction. In order to control the crystallinity and the softening point of the crystalline polyester resin, the polycondensation reaction may be performed using, as the alcohol component, a trihydric or higher polyalcohol such as glycerin and, as the acid component, a trivalent or higher polycarboxylic acid such as trimellitic anhydride to thereby obtain a non-linear polyester.

The molecular weight distribution of the crystalline polyester resin is not particularly limited and may be appropriately selected depending on the intended purpose. The molecular weight distribution thereof is preferably sharp. And, the crystalline polyester resin having a lower molecular weight is preferred since it is excellent in low-temperature fixability. In the molecular weight distribution diagram obtained through gel permeation chromatography (GPC) of its ortho-dichlorobenzene soluble matter where the horizontal axis represents log (M) and the vertical axis represents % by mass, it is preferred that a peak be located in a range of 3.5 to 4.0, and that the half width of the peak be 1.5 or less.

The weight average molecular weight (Mw) of the crystalline polyester resin is not particularly limited and may be appropriately selected depending on the intended purpose. Since it is difficult that the crystalline polyester resin having higher molecular weights keeps its sharp melt property, the weight average molecular weight (Mw) is preferably 1,000 to 30,000, more preferably 1,200 to 20,000.

The number average molecular weight (Mn) of the crystalline polyester resin is not particularly limited and may be appropriately selected depending on the intended purpose, but is preferably 500 to 6,000, more preferably 700 to 5,500.

The molecular weight distribution (Mw/Mn), which is expressed by a ratio of the weight average molecular weight (Mw) to the number average molecular weight (Mn), is not particularly limited and may be appropriately selected depending on the intended purpose, but is preferably 2 to 8.

When the molecular weight distribution (Mw/Mn) is less than 2, production is difficult to be performed, potentially leading to cost elevation. Whereas when it is more than 8, the sharp melt property of the crystalline polyester resin may be degraded.

The melting point of the crystalline polyester resin is preferably 60° C. to 130° C., more preferably 70° C. to 110° C. When the melting point thereof is lower than 60° C., the viscoelasticity of each toner of the toner set is decreased at low temperatures, so that its heat resistance storage stability may be degraded. Whereas it is higher than 130° C., the effect of decreasing its viscoelasticity is insufficient, so that its low-temperature fixability may be insufficient.

The melting point of the crystalline polyester resin can be determined from, for example, a DSC curve obtained through differential scanning calorimetry (DSC).

The acid value of the crystalline polyester resin is not particularly limited and may be appropriately selected depending on the intended purpose, but is preferably 5 mgKOH/g or higher, more preferably 10 mgKOH/g or higher. Notably, from the viewpoint of improvements in hot offset resistance, the acid value is preferably 45 mgKOH/g or lower.

When the acid value is lower than 5 mgKOH/g, satisfactory affinity between recording media (paper) and the binder resin cannot be obtained in some cases. In addition, the intended low-temperature fixability cannot be achieved in some cases.

The acid value of the crystalline polyester resin can be measured as follows, for example. Specifically, the crystalline polyester resin is dissolved in 1,1,1,3,3,3-hexafluoro-2-propanol and the resultant solution is subjected to titration.

The hydroxyl value of the crystalline polyester resin is not particularly limited and may be appropriately selected depending on the intended purpose, but is preferably 0 mgKOH/g to 50 mgKOH/g, more preferably 5 mgKOH/g to 50 mgKOH/g.

When the hydroxyl value thereof is higher than 50 mgKOH/g, it may be impossible to attain both good low-temperature fixability and good charging property.

The hydroxyl value of the crystalline polyester resin can be measured as follows, for example. Specifically, the crystalline polyester resin is dissolved in 1,1,1,3,3,3-hexafluoro-2-propanol and the resultant solution is subjected to titration.

The amount of the crystalline polyester resin contained in the transparent toner of the toner set is preferably more than that of in the chromatic toner of the toner set. When the amount of the crystalline polyester resin contained in the transparent toner is less than that of in the chromatic toner, a large difference in glossiness may not be achieved between the transparent toner and the chromatic toner.

The amount of the crystalline polyester resin contained in the transparent toner of the toner set is not particularly limited and may be appropriately selected depending on the intended purpose, but is preferably 5% by mass or more, more preferably 5% by mass to 20% by mass, further preferably 6% by mass to 15% by mass. When the amount is less than 5% by mass, the transparent toner may not be sufficiently decreased in viscosity, so that high glossiness may not be achieved. When the amount is more than 20% by mass, hot offset resistance may not be ensured. Additionally, an oil phase is significantly increased in viscosity during manufacturing the transparent toner, potentially leading to difficulty in granulating.

The amount of the crystalline polyester resin contained in the chromatic toner of the toner set is not particularly limited and may be appropriately selected depending on the intended purpose, but is preferably 2% by mass to 15% by mass, more preferably 3% by mass to 10% by mass.

<Releasing Agent>

In order to ensure satisfactory releasing property, both of the transparent toner and the chromatic toner of the toner set contain a releasing agent.

The amount of the releasing agent contained in the transparent toner is preferably more than that of in the chromatic toner. The transparent toner has lower viscosity than the chromatic toner in order to exhibit high glossiness, therefore, the transparent toner may have lower hot offset resistance than the chromatic toner. However, hot offset can be prevented from occurring by previously adding a large amount of the releasing agent to the transparent toner.

The amount of the releasing agent contained in the transparent toner is not particularly limited and may be appropriately selected depending on the intended purpose, but is preferably 2% by mass to 13% by mass, more preferably 3% by mass to 10% by mass. When the amount is less than 2% by mass, it may be difficult to ensure satisfactory releasing property. When the amount is more than 13% by mass, image quality tends to be degraded due to toner spent to a carrier.

The amount of the chromatic toner in the releasing agent is not particularly limited and may be appropriately selected depending on the intended purpose, but is preferably 0.05% by mass to 10% by mass, more preferably 1% by mass to 8% by mass.

The melting point of the releasing agent is not particularly limited and may be appropriately selected depending on the intended purpose, but is preferably 50° C. to 120° C., more preferably 70° C. to 100° C.

Since the releasing agent can effectively act as a releasing agent at the interface between a fixing roller and a toner, hot offset resistance of a toner can be improved without applying a releasing agent, such as oil, to the fixing roller.

Notably, the melting point of the releasing agent was determined from a DSC curve obtained through differential scanning calorimetry (DSC). The DSC curve can be obtained using TA-60WS and DSC-60 (product of Shimadzu Corporation).

The releasing agent is not particularly limited and may be appropriately selected depending on the intended purpose. Examples thereof include polyolefin waxes (e.g., polyethylene wax, polypropylene wax); long-chain hydrocarbons (e.g., paraffin wax) and carbonyl group-containing waxes (e.g., esters, ketones). These may be used alone or in combination. Among them, carbonyl group-containing waxes are particularly preferable.

Examples of the carbonyl group-containing wax include polyalkanate esters (e.g. carnauba wax, montan wax, trimethylolpropane tribehenate, pentaerythritol tetrabehenate, pentaerythritol diacetate dibehenate, glycerine tribehenate, and 1,18-octadecanediol distearate), polyalkanol esters (e.g. tristearyl trimellitate and distearyl maleate), polyalkanic acid amides (e.g. ethylenediamine dibehenyl amide), polyalkyl amides (e.g. tristearyl trimellitate amide), and dialkyl ketones (e.g. distearyl ketone).

<Colorant in Chromatic Toner>

A colorant in the chromatic toner is not particularly limited and may be appropriately selected depending on the intended purpose. Examples of the colorant include carbon black, oil yellow, pigment yellow L, tartrazinelake, cadmium red, quinacridone red, phthalocyanin blue, fast sky blue, malachite green lake, phthalocyanine green, anthraquinon green, and titanium oxide. These may be used alone or in combination.

The amount of the colorant is not particularly limited and may be appropriately selected depending on the intended purpose, but is preferably 1% by mass to 15% by mass, more preferably 3% by mass to 10% by mass relative to that of the chromatic toner.

The colorant may be mixed with a resin to form a masterbatch and may be used as a masterbatch. Examples of the resin which is used for producing the masterbatch or which is kneaded together with the masterbatch include the above-described modified or unmodified polyester resins; styrene polymers and substituted products thereof (e.g., polystyrenes and polyvinyltoluenes); styrene-propylene copolymers, styrene-vinyltoluene copolymers, styrene-vinylnaphthalene copolymers, styrene-methyl acrylate copolymers, aliphatic or alicyclic hydrocarbon resins; aromatic petroleum resins; chlorinated paraffins; and paraffin waxes. These may be used alone or in combination.

The masterbatch can be prepared by mixing and kneading a colorant with a resin for use in a masterbatch through application of high shearing force. An organic solvent may also be used for improving interactions between the colorant and the resin. Furthermore, the so-called flashing method, in which an aqueous paste containing a colorant is mixed and kneaded with a resin and an organic solvent and then the colorant is transferred to the resin to remove water and the organic solvent, is preferably used, since a wet cake of the colorant can be directly used (i.e., no drying is required). For this mixing and kneading, a high-shearing dispersing device (e.g., a three-roll mill) is preferably used.

<Other Ingredients>

The other ingredients are not particularly limited and may be appropriately selected depending on the intended purpose. Examples thereof include charge-controlling agents, resin particles, external additives, flowability improving agents, cleanability improving agents and magnetic materials.

—Charge Controlling Agent—

The charge controlling agent is not particularly limited and may be appropriately selected depending on the intended purpose. Examples thereof include alkoxy amines, quaternary ammonium salts (including fluorine-modified quaternary ammonium salts), alkylamides, fluoroactive agents, metal salts of salicylic acid, and metal salts of salicylic acid derivatives. These may be used alone or in combination.

The charge-controlling agent may be a commercially available product. Examples of the commercially available product include nigrosine dye BONTRON 03, quaternary ammonium salt BONTRON P-51, and polymeric compounds having a functional group such as a sulfonic acid group, a carboxyl group or a quaternary ammonium salt.

The amount of the charge-controlling agent in each toner of the toner set depends on the type of the binder resin, the presence or absence of additive(s) and the dispersing method employed and therefore cannot be unequivocally determined. The amount thereof is preferably 0.1 parts by mass to 10 parts by mass, more preferably 0.2 parts by mass to 5 parts by mass, per 100 parts by mass of the resin component. When it is less than 0.1 parts by mass, favorable charge controlling properties may not be obtained. Whereas when it is greater than 10 parts by mass, the chargeability of each toner of the toner set is so large that the effects of a main charge-controlling agent are reduced, and the electrostatic attraction force between the toner and a developing roller increases, potentially leading to degradation of the fluidity of a developer and/or image density.

The charge-controlling agent may be dissolved or dispersed in the toner after melt-kneaded with the masterbatch and the resin. Needless to say, the charge-controlling agent may be directly added to the organic solvent together with the components of the toner when they are dissolved or dispersed, or may be fixed on the surface of each toner particles of the toner set after the formation of the toner particles.

—Resin Particles—

The resin particles are not particularly limited and may be appropriately selected depending on the intended purpose. Examples thereof include vinyl resins, polyurethane resins, epoxy resins and polyester resins. Among them, vinyl resins, polyurethane resins, epoxy resins, polyester resins or combinational use thereof are preferred since it is easy to obtain an aqueous dispersion of spherical resin particles, with vinyl resins being more preferred.

The vinyl resins are homopolymers or copolymers of vinyl monomers. Examples of the vinyl resins include styrene-(meth)acrylic acid ester resins, styrene-acrylonitrile copolymers, and styrene-butyl methacrylate copolymers, with styrene-butyl methacrylate copolymers being preferred.

The resin particles may be copolymers formed of monomers each containing at least two unsaturated groups.

The monomer containing at least two unsaturated groups is not particularly limited and may be appropriately selected depending on the intended purpose. Examples thereof include a sodium salt of sulfuric acid ester of methacrylic acid-ethylene oxide adduct ("ELEMINOL RS-30," product of Sanyo Chemical Industries, Ltd.), divinyl benzene and 1,6-hexanediol acrylate.

The glass transition temperature (Tg) of the resin particles is preferably 50° C. to 70° C. When the glass transition temperature (Tg) is lower than 50° C., each toner of the toner set is degraded in heat resistance storage stability, so that blocking may occur during storage and in a developing unit. Whereas when it is higher than 70° C., the resin particles impair adhesiveness to paper, so that the minimum fixing temperature may be increased.

The weight average molecular weight of the resin particles is not particularly limited and may be appropriately selected depending on the intended purpose, but is preferably 9,000 to 200,000. When the weight average molecular weight thereof is lower than 9,000, the obtained toner may be degraded in heat resistance storage stability. Whereas when it is higher than 200,000, the obtained toner may be degraded in low-temperature fixability.

The average particle diameter of the resin particles is preferably 5 nm to 200 nm, more preferably 20 nm to 150 nm.

The amount of the resin particles is not particularly limited and may be appropriately selected depending on the intended purpose, but is preferably 0.5% by mass to 5.0% by mass. When the amount thereof is less than 0.5% by mass, it may be difficult to control the surface hardness and the fixability of each toner of the toner set. Whereas when it is more than 5.0% by mass, the resin particles prevent the wax from exuding, potentially causing offset.

—External Additive—

The external additive is not particularly limited and may be appropriately selected depending on the intended purpose. Examples thereof include silica particles, hydrophobized silica particles, titanium oxide particles, hydrophobized titanium oxide particles and alumina particles. Among them, silica particles, titanium oxide particles and hydrophobized titanium oxide particles are preferred.

The silica particles may be commercially available products. Examples thereof include R972 and R974 (product of AEROSIL Japan).

Examples of the titanium oxide particles include P-25 (product of AEROSIL Japan), STT-30, STT-65C-S (these products are of Titan Kogyo, Ltd.), and MT-600B, MT-150A (these products are of TAYCA Corporation).

Examples of the hydrophobized titanium oxide particles include T-805 (product of AEROSIL Japan), STT-30A, STT-65S-S (these products are of Titan Kogyo, Ltd.), and TAF-500T, TAF-1500T (these products are of Fuji Titanium Industry Co., Ltd.).

The hydrophobized silica particles, hydrophobized titanium oxide particles and hydrophobized alumina particles can be obtained by, for example, treating hydrophilic particles with a silane coupling agent such as methyltrimethoxysilane, methyltriethoxysilane or octyltrimethoxysilane. In addition, suitably used are silicone oil-treated oxide particles or silicone oil-treated inorganic particles which are obtained by treating inorganic particles with silicone-oil, if necessary with heating.

Examples of the silicone oil include dimethyl silicone oil, methylphenyl silicone oil, methylhydrogen silicone oil, alkyl-modified silicone oil and fluorine-modified silicone oil. Examples of the inorganic particles include silica, alumina, titanium oxide, barium titanate, magnesium titanate, calcium titanate and strontium titanate. Among them, silica and titanium oxide are particularly preferred.

The amount of the external additive is not particularly limited and may be appropriately selected depending on the intended purpose, but is preferably 0.1% by mass to 5% by mass, more preferably 0.3% by mass to 3% by mass relative to that of each toner of the toner set.

The average particle diameter of primary particles of the inorganic particles is not particularly limited and may be appropriately selected depending on the intended purpose, but is preferably 100 nm or less, more preferably 3 nm to 70 nm. When the average particle diameter of primary particles of the inorganic particles is less than 3 nm, the inorganic particles are embedded in each toner of the toner set, making it difficult for them to effectively exhibit their functions. Whereas when the average particle diameter of primary particles of the inorganic particles is more than 100 nm, the inorganic particles may unevenly scratch a surface of a photoconductor.

—Flowability Improving Agent—

The flowability improving agent refers to an agent capable of improving hydrophobic properties through surface treatment and preventing degradation of flowability and chargeability even under high humidity environment. Examples thereof include silane coupling agents, silylation agents, silane coupling agents having a fluorinated alkyl group, organotitanate coupling agents, aluminum coupling agents, silicone oils, and modified silicone oils.

—Cleanability Improving Agent—

The cleanability improving agent is added to the toner for removing each toner of the toner set remaining after transfer on a photoconductor and primary transfer medium. Examples of the cleanability improving agent include stearic acid, metal salts of fatty acids such as zinc stearate and calcium stearate, polymer particles formed by soap-free emulsion polymerization, such as polymethyl methacrylate particles and polystylene particles. The polymer particles preferably have a relatively narrow particle size distribution. It is preferable that the volume average particle diameter thereof be 0.01 μm to 1 μm.

—Magnetic Material—

The magnetic material is not particularly limited and may be appropriately selected depending on the intended purpose. Examples thereof include iron powder, magnetite and ferrite. It is preferably white in terms of color tone.

<Production Method of Toner Set>

A production method of the chromatic toner and transparent toner of the toner set is not particularly limited and may be appropriately selected from conventionally known production methods of toner depending on the intended purpose. Examples thereof include a kneading pulverization method, a polymerization method, a dissolution suspension method, and a spray granulation method.

<<Kneading Pulverization Method>>

In the kneading pulverization method, base particles of each toner of the toner set are produced by melt kneading toner materials of each toner of the toner set containing, for example, at least a binder resin and a releasing agent to obtain a kneaded mixture, and pulverizing the kneaded mixture into particles and then classifying the particles. In the melt kneading, the toner materials of each toner of the toner set are mixed, and the mixture is placed in a melt-kneader and melt-kneaded. As the melt-kneader, single-screw or double-screw continuous kneaders and batch kneaders using roll mill can be used. For example, KTK type double-screw extruder (product of KOBE STEEL, LTD.); TEM type double-screw extruder (product of TOSHIBA MACHINE CO., LTD.); double-screw extruder (product of KCK Co., Ltd.); PCM type double-screw extruder (product of Ikegai Corp.); or Co-kneader (product of Buss Co.) are preferably used. The melt kneading is preferably carried out under appropriate conditions so as not to cut off molecular chains of the binder resin. Specifically, the melt kneading temperature is set with reference to the softening point of the binder resin. If the melt kneading temperature is excessively higher than the softening point of the binder resin, molecular chains of the binder resin are strongly cut off, and if it is excessively lower than the softening point of the binder resin, the toner materials may not be progressively dispersed.

In the pulverization, the kneaded mixture obtained in the kneading treatment is pulverized. It is preferable that firstly, the kneaded mixture is coarsely crushed, and then finely pulverized. On this occasion, the kneaded mixture is preferably pulverized by being crashed to a collision board in a jet stream, being crashed to each other in a jet stream, or pulverized in a narrow gap between a mechanically rotating rotator and a stator.

In the classification, the pulverized product obtained in the pulverization is classified so as to obtain particles having a predetermined particle size. The classification can be carried out by removing fine particles with the use of a cyclone, a decanter, or a centrifuge separator. After completion of the pulverization and classification, the pulverized product is classified in an air stream using a centrifugal force, thereby base particles of each toner of the toner set having predetermined particle size can be produced.

Subsequently, external additives are added to the base particles of each toner of the toner set. By mixing and stirring the base particles of each toner of the toner set and external additives in a mixer, surfaces of the base particles of each toner of the toner set are coated with the external additives while the external additives being cracked. On this occasion, it is important, in terms of durability, to make external additives such as inorganic particles and resin particles uniformly and tightly adhere to the base particles of each toner of the toner set.

<<Production Method of Toner Set in Aqueous Medium>>

The chromatic toner and the transparent toner of the toner set is preferably produced by a granulation method in which each toner of the toner set is granulated in aqueous medium in that the resultant toner has sharper particle size distribution than the toner produced by the pulverization method and has improved image uniformity. The granulation method is preferably performed by removing an organic solvent from an O/W type dispersion liquid in which oil phase containing at least a binder resin and a releasing agent dissolved in the organic solvent are dispersed in aqueous medium, to thereby granulate each toner of the toner set. Specifically, the granulation method includes an oil phase preparation step, an aqueous phase preparation step, a toner set dispersion liquid preparation step, and a solvent removal step; and, if necessary, further includes other steps.

<<Oil Phase Preparation Step>>

The oil phase preparation step is not particularly limited and may be appropriately selected depending on the intended purpose so long as it is a step of dissolving or dispersing, in an organic solvent, an active hydrogen group-containing compound, a binder resin precursor containing a site reactive with the active hydrogen group-containing compound, a binder resin containing a non-crystalline resin and a crystalline resin, a releasing agent and, in the case of the chromatic toner, a colorant, to thereby prepare a solution or dispersion liquid.

The oil phase preparation step is performed by, for example, a method in which an active hydrogen group-containing compound, a binder resin precursor containing a site reactive with the active hydrogen group-containing compound, a binder resin containing a non-crystalline resin and a crystalline resin, a releasing agent, and an optionally used colorant and charge-controlling agent are gradually added to the organic solvent under stirring to dissolve or disperse them in the organic solvent.

In the case of the chromatic toner, when a pigment is used as the colorant or when ingredients poorly dissolvable in the organic solvent such as the charge-controlling agent are added to the organic solvent, these ingredients are preferably micronized prior to the addition of them to the organic solvent.

The formation of the colorant into a masterbatch is one suitable method, and the same method can be applied to the ester wax and the charge-controlling agent.

In the case of the chromatic toner, after the colorant, the releasing agent and the optionally used charge-controlling agent which have been dispersed by the above method are dissolved or dispersed in the organic solvent together with the active hydrogen group-containing compound, the binder resin precursor containing the site reactive with the active hydrogen group-containing compound and the binder resin, the resultant solution or dispersion liquid may further be dispersed. This dispersion can be performed using a known disperser such as a beads mill or a disc mill.

Also, in order to increase the mechanical strength of each toner of the toner set and prevent high-temperature offset during fixing, each toner of the toner set is preferably produced in a state where the binder resin precursor containing the site reactive with the active hydrogen group-containing compound has been dissolved in the oil phase; i.e., in a state where the oil phase contains the active hydrogen group-containing compound and the binder resin precursor.

The organic solvent used in the oil phase preparation step is not particularly limited and may be appropriately selected depending on the intended purpose. The organic solvent preferably has the boiling point of lower than 100° C. since such organic solvent can easily be removed. Examples of such organic solvent include toluene, xylene, benzene, carbon tetrachloride, methylene chloride, 1,2-dichloroethane, methyl acetate, ethyl acetate, methyl ethyl ketone and methyl isobutyl ketone. These may be used alone or in combination.

When the binder resin to be dissolved or dispersed in the organic solvent is a resin having a polyester skeleton, use of ester solvents such as methyl acetate, ethyl acetate and butyl acetate, and ketone solvents such as methyl ethyl ketone and methyl isobutyl ketone is preferred since they are excellent in dissolution capability. Among them, particularly preferred are methyl acetate, ethyl acetate and methyl ethyl ketone since they can easily be removed.

<<Aqueous Phase Preparation Step>>

The aqueous phase preparation step is not particularly limited and may be appropriately selected depending on the intended purpose so long as it is a step of preparing an aqueous phase.

The aqueous medium used in the aqueous phase preparation step is not particularly limited and may be appropriately selected depending on the intended purpose. Example thereof includes water. The aqueous medium may be water alone or a mixture of water and a water-miscible organic solvent. Examples of the water-miscible organic solvent include alcohols (e.g., methanol, isopropanol and ethylene glycol), dimethylformamide, tetrahydrofuran, cellosolves (e.g., methyl cellosolve) and lower ketones (e.g., acetone and methyl ethyl ketone).

The aqueous medium preferably further contains a surfactant.

The surfactant is not particularly limited and may be appropriately selected depending on the intended purpose. Examples thereof include anionic surfactants such as alkylbenzenesulfonic acid salts, α-olefin sulfonic acid salts, phosphoric acid esters and disulfonic acid salts; cationic surfactants such as alkyl amine salts, aminoalcohol fatty acid derivatives, polyamine fatty acid derivatives and quaternary ammonium salts (e.g., benzethonium chloride); and amphoteric surfactants such as fatty acid amide derivatives. Among them, in order to efficiently disperse oil droplets containing the solvent, disulfonic acid salts having a relatively high HLB are preferred.

The amount of the surfactant in the aqueous medium is not particularly limited and may be appropriately selected depending on the intended purpose. The concentration of the surfactant in the aqueous medium is preferably 3% by mass to 10% by mass, more preferably 4% by mass to 9% by mass, particularly preferably 5% by mass to 8% by mass. When the concentration thereof is lower than 3% by mass, the oil droplets cannot be stably dispersed so as to form coarse oil droplets. When the concentration thereof is higher than 10% by mass, each oil droplet becomes too small or forms an inverted micellar structure, so that the dispersion stability is conversely degraded due to the surfactant, potentially forming coarse oil droplets.

<<Toner Set Dispersion Liquid Preparation Step>>

The toner set dispersion liquid preparation step is not particularly limited and may be appropriately selected depending on the intended purpose, so long as it is a step of dispersing the oil phase in the aqueous phase to thereby prepare an emulsified dispersion liquid (i.e., a dispersion liquid of the chromatic toner and the transparent toner of the toner set, hereinafter may be referred to as a toner set dispersion liquid).

The dispersion method is not particularly limited and may be appropriately selected depending on the intended purpose. Examples thereof include a dispersion method using a known disperser such as a low-speed shearing disperser, a high-speed shearing disperser, a friction disperser, a high-pressure jet disperser or an ultrasonic disperser. Among them, dispersion using a high-speed shearing disperser is preferred in order to form base particles of each toner of the toner set having a particle diameter of 2 μm to 20 μm. In the case where the high-speed shearing disperser is used, the rotation speed is not particularly limited and may be appropriately selected depending on the intended purpose, but is preferably 1,000 rpm to 30,000 rpm, more preferably 5,000 rpm to 20,000 rpm. The dispersion time is not particularly limited and may be appropriately selected depending on the intended purpose, but is preferably 0.1 min to 5 min in a batch method. When the dispersion time exceeds 5 min, small particles remain or excessive dispersion is performed to make the dispersion system unstable, potentially forming aggregates and coarse particles. The dispersion temperature is not particularly limited and may be appropriately selected depending on the intended purpose, but is preferably 0° C. to 40° C., more preferably 10° C. to 30° C. When the dispersion temperature is lower than 0° C., the dispersion is increased in viscosity to require increased shearing energy for dispersing, potentially leading to a drop in production efficiency. When it exceeds 40° C., molecular movements are excited to degrade dispersion stability, potentially forming aggregates and coarse particles easily.

A dispersing agent may be used for emulsifying or dispersing, in water-containing liquid, oil phase containing material of each toner of the toner set dispersed therein. Examples thereof include anionic surfactants such as alkylbenzenesulfonic acid salts; cationic surfactants such as amine salts (e.g., alkyl amine salts) and quaternary ammonium salts (e.g., alkyltrimethylammonium salts); nonionic surfactants such as fatty acid amide derivatives; and amphoteric surfactants such as alanine and dodecyldi(aminoethyl)glycine.

Also, use of a fluoroalkyl group-containing surfactant can provide advantageous effects even in a considerably small amount. Examples of anionic surfactants containing a fluoroalkyl group include fluoroalkyl carboxylic acids having 2 to 10 carbon atoms or metal salts thereof, disodium perfluorooctanesulfonylglutamate, sodium 3-[omega-fluoroalkyl (C6 to C11) oxy]-1-alkyl (C3 or C4) sulfonates, fluoroalkyl (C11 to C20) carboxylic acids or metal salts thereof, perfluoroalkylcarboxylic acids (C7 to C13) or metal salts thereof, perfluoroalkyl (C4 to C12) sulfonate or metal salts thereof.

The anionic surfactants containing a fluoroalkyl group may be commercially available products. Examples thereof include SURFLON S-111, S-112 and S-113 (these products are of Asahi Glass Co., Ltd.); FRORARD FC-93, FC-95, FC-98 and FC-129 (these products are of Sumitomo 3M Ltd.); UNIDYNE DS-101 and DS-102 (these products are of Daikin Industries, Ltd.); MEGAFACE F-110, F-120, F-113, F-191, F-812 and F-833 (these products are of DIC, Inc.); EFTOP EF-102, 103, 104, 105, 112, 123A, 123B, 306A, 501, 201 and 204 (these products are of Tohchem Products Co., Ltd.); and FUTARGENT F-100 and F150 (these products are of NEOS COMPANY LIMITED).

Examples of cationic surfactants containing a fluoroalkyl group include fluoroalkyl group-containing primary, secondary or tertiary aliphatic amine acids, aliphatic quaternary ammonium salts (e.g., perfluoroalkyl (C6 to C10) sulfonamide propyltrimethylammonium salts), benzalkonium salts, benzetonium chloride, pyridinium salts and imidazolinium salts.

The cationic surfactants containing a fluoroalkyl group may be commercially available products. Examples thereof include SURFLON S-121 (product of Asahi Glass Co., Ltd.); FRORARD FC-135 (product of Sumitomo 3M Ltd.); UNIDYNE DS-202 (product of Daikin Industries, Ltd.); MEGAFACE F-150 and F-824 (these products are of DIC, Inc.); EFTOP EF-132 (product of Tohchem Products Co., Ltd.); and FUTARGENT F-300 (product of Neos COMPANY LIMITED).

Examples of poorly water-soluble inorganic dispersing agents include tricalcium phosphate, calcium carbonate, titanium oxide, colloidal silica and hydroxyapatite.

Further, a polymeric protective colloid or water-insoluble organic particles may be used to stabilize liquid droplets. Examples thereof include acids (e.g., acrylic acid, methacrylic acid, fumaric acid, maleic acid and maleic anhydride); hydroxyl group-containing (meth)acrylic monomers (e.g., β-hydroxyethyl acrylate, β-hydroxyethyl methacrylate, β-hydroxypropyl acrylate, β-hydroxypropyl methacrylate and γ-hydroxypropyl acrylate); vinyl alcohol or ethers thereof (e.g., vinyl methyl ether and vinyl ethyl ether); esters formed between vinyl alcohol and a carboxyl group-containing compound (e.g., vinyl acetate and vinyl butyrate); acrylamide, methacrylamide, diacetoneacrylamide and methylol compounds of thereof, acid chlorides (e.g., acrylic acid chloride and methacrylic acid chloride); homopolymers or copolymers such as nitrogen-containing compounds or nitrogen-containing heterocyclic compounds (e.g., vinyl pyridine, vinyl pyrrolidone, vinyl imidazole and ethyleneimine); polyoxyethylenes (e.g., polyoxyethylenes, polyoxypropylenes, polyoxyethylene alkyl amines, polyoxypropylene alkyl amines); and celluloses (e.g., methyl cellulose, hydroxyethyl cellulose and hydroxypropyl cellulose).

When an acid- or alkali-soluble compound (e.g., calcium phosphate) is used as a dispersion stabilizer, the calcium phosphate is dissolved with an acid (e.g., hydrochloric acid), followed by washing with water, to thereby remove it from the formed particles. Also, the calcium phosphate may be removed through enzymatic decomposition.

Alternatively, when using the dispersing agent, the dispersing agent may remain on the surfaces of each toner of the toner set. However, the dispersing agent is preferably removed through washing after reaction in terms of chargeability of each toner of the toner set.

The amount of the organic solvent contained in the toner set dispersion liquid is not particularly limited and may be appropriately selected depending on the intended purpose, but is preferably 10% by mass to 70% by mass, more preferably 25% by mass to 60% by mass, particularly preferably 40% by mass to 55% by mass.

Notably, the amount of the organic solvent contained in the toner set dispersion liquid is an amount relative to the amount of the solid matter (e.g., the binder resin, the colorant, the releasing agent and, if necessary, the charge-controlling agent) in the toner set dispersion liquid.

<<Solvent Removal Step>>

The solvent removal step is not particularly limited and may be appropriately selected depending on the intended purpose so long as it is a step of removing the organic solvent contained in the toner set dispersion liquid. The solvent removal step is preferably a step of completely removing the organic solvent contained in the toner set dispersion liquid. In one employable means, the toner set dispersion liquid is gradually increased in temperature with stirring, to thereby completely evaporate off the organic solvent contained in the liquid droplets. In another employable means, the toner set dispersion liquid is sprayed toward a dry atmosphere with stirring, to thereby completely remove the organic solvent contained in the liquid droplets. In still another employable means, the toner set dispersion liquid is reduced in pressure with stirring to thereby evaporate off the organic solvent. The latter two means may be used in combination with the first means.

The dry atmosphere toward which the toner set dispersion liquid is sprayed is not particularly limited and may be appropriately selected depending on the intended purpose. Examples thereof include heated gas such as air, nitrogen, carbon dioxide gas and combustion gas.

The temperature of the dry atmosphere is not particularly limited and may be appropriately selected depending on the intended purpose. It is preferably a temperature equal to or higher than the highest boiling point of the solvents used.

The spraying is performed with, for example, a spray dryer, a belt dryer or a rotary kiln. Use of it can give a product having satisfactory quality in a short time.

<<Other Steps>>

The other steps are not particularly limited and may be appropriately selected depending on the intended purpose. Examples thereof include an aging step, a washing step and a drying step.

—Aging Step—

When the oil phase contains the polyester resin containing the functional group reactive with the active hydrogen group of the active hydrogen group-containing compound (prepolymer), an aging step is preferably performed for proceeding elongation and/or crosslinking reaction of the prepolymer.

The aging step is preferably performed after the solvent removal step and before the washing step.

The aging time in the aging step is not particularly limited and may be appropriately selected depending on the intended purpose, but is preferably 10 min to 40 hours, more preferably 2 hours to 24 hours.

The reaction temperature in the aging step is not particularly limited and may be appropriately selected depending on the intended purpose, but is preferably 0° C. to 65° C., more preferably 35° C. to 50° C.

—Washing Step—

The washing step is not particularly limited and may be appropriately selected depending on the intended purpose, so long as it is a step of washing each toner (base particles of each toner) contained in the toner set dispersion liquid subsequent to the solvent removal step or the aging step.

The toner set dispersion liquid contains not only base particles of each toner of the toner set but also subsidiary materials such as the dispersing agent (e.g., the surfactant). Thus, the toner set dispersion liquid is washed to separate only base particles of each toner of the toner set from the toner set dispersion liquid.

The washing method is not particularly limited and may be appropriately selected depending on the intended purpose. Examples thereof include a centrifugation method, a reduced-pressure filtration method and a filter press method. Any of the above methods forms a cake of base particles of each toner. When the base particles are not sufficiently washed through only one washing process, the formed cake may be dispersed again in an aqueous medium to form slurry, which is repeatedly treated with any of the above methods to taken out base particles of each toner. When a reduced-pressure filtration method or a filter press method is employed for washing, an aqueous medium may be made to penetrate the cake to wash out the subsidiary materials contained in base particles of each toner. The aqueous medium used for the washing is water or a solvent mixture of water and an alcohol such as methanol or ethanol. Water is preferably used from the viewpoint of reducing cost and environmental load caused by, for example, drainage treatment.

—Drying Step—

The drying step is not particularly limited and may be appropriately selected depending on the intended purpose, so long as it is a step of drying base particles of each toner of the toner set after the washing step.

The washed base particles of each toner containing a large amount of water are dried to remove the water, whereby only base particles of each toner can be obtained.

The method of removing water from the base particles of each toner is not particularly limited and may be appropriately selected depending on the intended purpose. Examples thereof include methods using dryers such as a spray dryer, a vacuum freezing dryer, a reduced-pressure dryer, a ventilation shelf dryer, a movable shelf dryer, a fluidized-bed-type dryer, a rotary dryer or a stirring-type dryer.

The removal of water is preferably performed until the water content of the base particles of each toner is decreased less than 1% by mass. Also, when the base particles of each toner after the removal of water somewhat flocculate to cause inconvenience in use, the flocculated particles may be separated from each other through beating using, for example, a jet mill, HENSCHEL MIXER or a super mixer.

—Classifying Step—

In the case where the particle size distribution of the base particles of each toner of the toner set in the emulsified and/or dispersed liquid is broad, the particle size distribution of the particles can be controlled by classification to have the predetermined particle size distribution. The classification may be performed before the drying step in liquid or after the drying step, but the classification is preferably performed in the liquid before the drying step from the viewpoint of high production efficiency of each toner of the toner set.

Examples of the classifying method in the liquid include removing fine particles using, for example, a cyclone, a decanter or a centrifuge.

The thus-removed unnecessary fine or coarse particles may be returned to the kneading step, where the unnecessary fine or coarse particles can be used for forming base particles of each toner of the toner set. In this case, the unnecessary fine or coarse particles may be in a wet state.

The dispersing agent used is preferably removed from the obtained emulsified and/or dispersed liquid to the greatest extent possible. The dispersing agent is may be removed at the same time as the classifying step.

<Addition Step of External Additive>

The thus obtained post-dried base particles of each toner of the toner set are mixed with other ingredients such as a charge-controlling agent, an external additive, a flowability improving agent and a cleanability improving agent and mechanical impact is applied to the resultant mixture, so that the foreign particles are fixed or fused on surfaces of the base particles of each toner of the toner set, to thereby prevent the foreign particles from being exfoliated from the surfaces of the toner.

Examples of the specific means include a method in which an impact is applied to a mixture which contains the base particles of each toner of the toner set and the other ingredients using a high-speed rotating blade and a method in which a mixture is caused to pass through a high-speed airflow for acceleration, and aggregated or complex toner base particles of each toner are crushed against an appropriate collision plate.

Apparatus used for the addition step of the external additive is not particularly limited and may be appropriately selected depending on the intended purpose. Example thereof include ONGMILL (product of Hosokawa Micron Corp.), an apparatus produced by modifying an I-type mill (product of Nippon Neumatic Co., Ltd.) so that the pulverizing air pressure thereof is decreased, HYBRIDIZATION SYSTEM (product of Nara Machinery Co., Ltd.), CRYPTRON SYSTEM (production of Kawasaki Heavy Industries, Ltd.) and an automatic mortar.

The volume average particle diameter of the transparent toner of the toner set of the present invention is not particularly limited and may be appropriately selected depending on the intended purpose, but is preferably 3 μm to 7 μm, more preferably 4 μm to 6 μm.

When the volume average particle diameter is less than 3 μm, a cleaning failure may be caused, leading to degradation of image quality. When the volume average particle diameter is more than 7 μm, the transparent toner is degraded in homogeneity, potentially leading to unevenness of image glossiness.

Meanwhile, the ratio of the volume average particle diameter (Dv) to the number average particle diameter (Dn) (Dv/Dn) of the transparent toner is not particularly limited and may be appropriately selected depending on the intended purpose, but is preferably 1.3 or less, more preferably 1.2 or less. When the ratio (Dv/Dn) is more than 1.3, image glossiness may be uneven.

The volume average particle diameter of the chromatic toner of the toner set of the present invention is not particularly limited and may be appropriately selected depending on the intended purpose, but is preferably 3 μm to 8 μm, more preferably 4 μm to 7 μm.

Meanwhile, the ratio of the volume average particle diameter (Dv) to the number average particle diameter (Dn) (Dv/Dn) of the chromatic toner is not particularly limited and may be appropriately selected depending on the intended purpose, but is preferably 1.3 or less, more preferably 1.2 or less.

The particle size distribution of the transparent toner and the chromatic toner of the toner set is measured using, for example, a particle size measuring device MULTISIZER III (product of Beckman Coulter, Inc.)

The toner set of the present invention is excellent in hot offset resistance. Additionally, the toner set can simultaneously achieve high glossiness and satisfactory fixability. Therefore, the toner set is suitably used in a developer set and an image forming apparatus of the present invention described below.

(Developer Set)

A developer set of the present invention contains the toner set of the present invention and carriers.

—Carrier—

The carrier is not particularly limited and may be appropriately selected depending on the intended purpose, but is preferably a carrier containing a core material and a resin layer covering the core material.

The material of the core material is not particularly limited and may be appropriately selected from known materials. For example, it is preferable to employ manganese-strontium (Mn—Sr) materials or manganese-magnesium (Mn—Mg) materials of 50 emu/g to 90 emu/g. Furthermore, it is preferable to employ high magnetization materials such as iron powder (100 emu/g or more) or magnetite (75 emu/g to 120 emu/g) for the purpose of securing image density. Moreover, it is preferable to employ low magnetization materials such as copper-zinc (Cu—Zn) (30 emu/g to 80 emu/g) because the impact toward the latent electrostatic image bearing member having the toner in the chain-like form can be relieved and because it is advantageous for higher image quality. These may be used alone or in combination.

The core preferably has the average particle diameter (volume average particle diameter ($D_{50}$)) of 10 μm to 200 μm, more preferably 40 μm to 100 μm. When the average particle diameter (volume average particle diameter ($D_{50}$)) is less than 10 μm, the amount of fine powder increases in the carrier, whereas magnetization per particle decreases and carrier scattering may occur. When it is greater than 200 μm, the specific surface area of the carrier decreases and thus toner scattering may occur. As a result, in the case of printing a full-color image having many solid portions, especially reproducibility of the solid portions may decrease.

The material for the resin layer is not particularly limited and may be appropriately selected from known resins depending on the intended purpose. Examples thereof include amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers formed of vinylidene fluoride and acrylic monomers, copolymers formed of vinylidene fluoride and vinyl fluoride, fluoroterpolmers (tri or multiple-fluoride copolymers) such as terpolymers formed of tetrafluoroethylene, vinylidene fluoride and non-fluorinated monomers, and silicone resins. These may be used alone or in combination. Among them, silicone resins are particularly preferable.

The silicone resins are not particularly limited and may be appropriately selected from known resins depending on the intended purpose. Examples thereof include straight silicone resins consisting of organosiloxane bonds and modified silicone resins modified by alkyd resin, polyester resin, epoxy resin, acrylic resin or urethane resin.

The straight silicone resins may be commercially available products. Examples thereof include: KR271, KR255, KR152 (these products are of Shin-Etsu Chemical Co., Ltd.); and SR2400, SR2406, SR2410 (these products are of Dow Corning Toray Co., Ltd.).

Also, the modified silicone resins may be commercially available products. Examples thereof include: KR206 (alkyd-modified), KR5208 (acryl-modified), ES1001N (epoxy-modified), and KR305 (urethane modified) (these products are of Shin-Etsu Chemical Co., Ltd.); and SR2115 (epoxy-modified) and SR2110 (alkyd-modified) (these products are of DOW CORNING TORAY SILICONE CO., LTD.)

Here, the silicone resins may be used alone, but it may be used in combination, for example, with a crosslinking component or a charge controlling component.

If necessary, the resin layer may further contain, for example, electroconductive powder. Examples of the electroconductive powder include metal powder, carbon black, titanium oxide, tin oxide and zinc oxide.

The average particle diameter of the electroconductive powder is preferably 1 μm or less. When the average particle diameter is in excess of 1 μm, electrical resistance may be difficult to control.

The resin layer may be formed, for example, as follows. Specifically, the silicone resin and other materials are dissolved in a solvent to prepare a coating liquid, and then the thus-prepared coating liquid is uniformly coated on the surface of the core material with a known coating method, followed by drying and then baking. Examples of the coating method include immersion coating methods, spray methods and brush coating methods.

The solvent is not particularly limited and may be appropriately selected depending on the intended purpose. Examples thereof include toluene, xylene, methyl ethyl ketone, methyl isobutyl ketone, cellosolve and butyl acetate.

The baking method is not particularly limited and may be appropriately selected depending on the intended purpose. It may be an external or internal heating method. Examples of the baking method include methods employing a fixed-type electric furnace, a fluid-type electric furnace, a rotary electric furnace or a burner furnace; and methods employing microwave radiation.

The amount of the resin layer in the carrier is preferably 0.01% by mass to 5.0% by mass. When the amount thereof is less than 0.01% by mass, a uniform resin layer may not be formed on the surface of the core material. Whereas when it is more than 5.0% by mass, the formed resin layer becomes so thick that adhesion between carrier particles occurs, potentially resulting in failure to form uniform carrier particles.

The amount of the carrier contained in the developer set is not particularly limited and may be appropriately selected depending on the intended purpose, but is preferably 90% by mass to 98% by mass, more preferably 93% by mass to 97% by mass.

In the developer set, the mixing ratio of each toner of the toner set to the carrier is generally 1 part by mass to 10 parts by mass of the toner, per 100 parts by mass of the carrier.

(Image Forming Apparatus and Image Forming Method)

An image forming apparatus of the present invention includes a latent electrostatic image bearing member, a charging unit, an exposing unit, a developing unit, a transfer unit and a fixing unit; and may further include a cleaning unit, and, if necessary, appropriately selected other units such as a charge-eliminating unit, a recycling unit and a controlling unit. Notably, the charging unit and the exposing unit are collectively referred to as "latent electrostatic image forming unit."

An image forming method of the present invention includes a charging step, an exposing step, a developing step, a transfer step and a fixing step; and may further include a cleaning step, and, if necessary, appropriately selected other steps such as a charge-eliminating step, a recycling step and a controlling step. Notably, the charging step and the exposing step are collectively referred to as "latent electrostatic image forming step."

According to the image forming apparatus and image forming method of the present invention, the toner set of the present invention can be used to easily form a color image having different glossiness at only a desired region.

The image forming method of the present invention can suitably be performed by the image forming apparatus of the present invention, where the charging step can be performed by the charging unit, the exposing step can be performed by the exposing unit, the developing step can be performed by the developing unit, the transfer step can be performed by the transfer unit, the fixing step can be performed by the fixing unit, the cleaning step can be performed by the cleaning unit, and the other steps can be performed by the other units.

<Latent Electrostatic Image Bearing Member>

The material, shape, structure and size of the latent electrostatic image bearing member are not particularly limited and may be appropriately selected depending on the intended purpose. Regarding the shape, it is, for example, in the form of a drum, a sheet or an endless-belt. Regarding the structure, it may have a monolayer structure or a laminated structure. Regarding the size, it may be appropriately selected depending on, for example, size or spec of the image forming apparatus. Regarding the material, it is, for example, an inorganic photoconductor made of amorphous silicon, selenium, CdS, or ZnO and an organic photoconductor (OPC) made of polysilane or phthalopolymethine.

<Charging Step and Charging Unit>

The charging step is a step of charging a surface of the latent electrostatic image bearing member and performed by a charging unit. The charging unit is not particularly limited and may be appropriately selected depending on the intended purpose, so long as it can apply a voltage to and uniformly charge a surface of the latent electrostatic image bearing member. The charging unit is broadly classified into (1) a contact type charging unit configured to charge the latent electrostatic image bearing member in a contact manner and (2) a non-contact type charging unit configured to charge the latent electrostatic image bearing member in a non-contact manner.

Examples of the contact type charging unit described in (1) include an electroconductive or semi-electroconductive charging roller, a magnetic brush, a fur brush, a film and a rubber blade. Among them, the charging roller is preferred because it allows for drastically reducing the amount of ozone generation as compared with corona discharge type devices, is excellent in stability in repetitive use of the latent electrostatic image bearing member, and is effective in preventing image degradation. Examples of the non-contact type charging unit described in (2) include a non-contact type charger utilizing corona discharge, a needle electrode device, a solid discharge element; and an electroconductive or semielectroconductive charging roller disposed while keeping a microgap with respect to the latent electrostatic image bearing member.

<Exposing Step and Exposing Unit>

The exposing step is a step of exposing a surface of the charged latent electrostatic image bearing member and performed by the exposing unit. The exposing can be performed by, for example, imagewise exposing the surface of the latent electrostatic image bearing member to light using the exposing unit.

An optical system in the exposing is broadly classified into an analog optical system and a digital optical system. The analog optical system is an optical system in which a manuscript is directly projected onto a latent electrostatic image bearing member. The digital optical system is an optical system in which image information is given as electrical signals which are then converted into light signals, and a latent electrostatic image bearing member is exposed to the light signals to thereby form an image.

The exposing unit is not particularly limited and may be appropriately selected depending on the purpose, so long as it attains desired imagewise exposure on the surface of the latent electrophotographic image bearing member charged with the charging unit. Examples thereof include various exposing devices such as a copy optical exposing device, a rod lens array exposing device, a laser optical exposing device, a liquid crystal shutter exposing device, and an LED optical exposing device. In the present invention, light may be imagewise applied from the side facing the support of the latent electrostatic image bearing member.

<Developing Step and Developing Unit>

The developing step is a step of developing the latent electrostatic image with the toner set or the developer set of the present invention to thereby form a visible image. The visible image can be formed with the developing unit by, for example, developing the latent electrostatic image using the toner set or the developer set.

The order of developing with the transparent toner and the chromatic toner on the recording medium is not particularly limited and may be appropriately selected depending on the intended purpose. For example, the developed may be performed with the transparent toner and then with the chromatic toner. Alternatively, the developed may be performed with the chromatic toner and then with the transparent toner. An image (visible image) having suitable glossiness can be formed in any order.

Further, the developing with the transparent toner may be performed on an entire surface or only a desired region of the recording medium, which makes it possible to form a visible image on which some region has glossiness but other region has no glossiness. Notably, use of the transparent toner in the developing can provide glossiness to the recording medium. Accordingly, an image forming apparatus using only the transparent toner cannot form a visible image. Such recording medium having glossiness also falls within the scope of the present invention.

The developing unit is not particularly limited and may be appropriately selected from known developing units depending on the intended purpose, as long as it can perform developing using the toner set or the developer set. Suitable example thereof includes those contain the toner set or the developer set, and have at least a developing unit which can provide the toner set or the developer set to the latent electrostatic image in a contact manner or non-contact manner.

The developing unit may employ a dry or wet developing process, and may be a single-color or multi-color developing device. Suitable examples of the developing unit include one having a rotatable magnetic roller and a stirrer for charging the toner set or the developer set with friction generated during stirring.

In the developing unit, the toner set and the carrier are stirred and mixed so that the toner is charged by friction generated therebetween. The charged toner is retained in the chain-like form on the surface of the rotating magnetic roller to thereby form magnetic brushes. The magnetic roller is disposed proximately to the latent electrostatic image developing member and thus, some of the toner set forming the magnetic brushes on the magnet roller are transferred onto the surface of the latent electrostatic image developing member by the action of electrically attractive force. As a result, the latent electrostatic image is developed with the toner set to form a visual toner image on the surface of the latent electrostatic image developing member.

The developer set contained in the developing unit is a developer set containing the toner set.

<Transfer Step and Transfer Unit>

The transfer step is a step of transferring the visible image onto a recording medium, and performed by the transfer unit. The transfer unit is broadly classified into a transfer unit configured to directly transfer a visible image formed on a latent electrostatic image bearing member onto a recording medium, and a transfer unit configured to primarily transfer a visible image onto an intermediate transfer medium and then secondarily transfer the visible image onto the recording medium.

For example, the transferring of the visible image can be performed with the transfer unit by charging the latent electrostatic image bearing member with a transfer charger. Suitable aspect of the transfer unit includes those having a primary transfer unit configured to transfer a visible image to an intermediate member to form a composite transfer image; and a secondary transfer unit configured to transfer the composite transfer image onto a recording medium.

The intermediate transfer member is not particularly limited and may be appropriately selected from known transfer members depending on the intended purpose. Examples thereof include a transfer belt or a transfer roller.

The transfer unit (the primary transfer unit and the secondary transfer unit) preferably includes at least a transfer device which transfers the visible images formed on the latent electrostatic image bearing member onto the recording medium through charging. The number of the transfer device may be one or two or more. Examples of the transfer device include a corona transfer device employing corona discharge, a transfer belt, a transfer roller, a pressing transfer roller and an adhesive transfer device.

The recording medium is typically plane paper, but it is not particularly limited and may be appropriately selected depending on the intended purpose so long as it can receive an unfixed image after developing. PET bases for OHP can also be used as the recording medium.

<Fixing Step and Fixing Unit >

The fixing step is a step of fixing the transferred visible image on a recording medium using a fixing unit.

The fixing unit is not particularly limited and may be appropriately selected depending on the intended purpose, however, a fixing device having fixing members and a heat source for heating the fixing member is preferably used.

The fixing member is not particularly limited and may be appropriately selected depending on the intended purpose, as long as it can be in contact with each other to form a nip. Examples of the fixing members include a combination of an endless belt and a roller, and a combination of a roller and a roller. In view of shorter warm-up period and energy saving, a combination of an endless belt and a roller or induction heating where the transferred image is heated from the surfaces of fixing members, is preferably employed.

In the fixing step, the toner image is transferred onto the recording medium, the recording medium having the image may be passed through the nip to thereby fix the image on the recording medium. Alternatively, the image may be transferred and also fixed on the recording medium simultaneously at the nip. The nip is formed by contacting at least two fixing members each other.

In addition, the fixing step may be performed for each color toner at every transferring onto the recording medium or may be performed for color toner images all together in a state where all the color toner images are superimposed.

The fixing temperature of the toner (i.e. the surface temperature of the fixing member heated by the heating unit) is not particularly limited and may be appropriately selected depending on the intended purpose, but is preferably 100° C. to 170° C., more preferably 120° C. to 160° C. When the fixing temperature is lower than 100° C., it may result in insufficient fixability, and when higher than 170° C., it is undesirable in terms of energy saving.

<Cleaning Step and Cleaning Unit>

The cleaning step is a step of removing each toner of the toner set remaining on the latent electrostatic image bearing member, and can be preferably performed by a cleaning unit. In the case where the developing unit has a developer bearing member that contacts with the surface of the latent electrostatic image bearing member; and develops a latent electrostatic image formed on the latent electrostatic image bearing member as well as collects a residual toner remaining on the latent electrostatic image bearing member, then the cleaning may be performed without the cleaning unit in a cleaning-less manner.

The cleaning unit is not particularly limited and may be appropriately selected from known cleaners, so long as it can remove a residual remaining on the latent electrostatic image bearing member. Examples of the cleaning unit include a magnetic blush cleaner, an electrostatic brush cleaner, a magnetic roller cleaner, a cleaning blade, a brush cleaner and a web cleaner. Among them, cleaning blades are particularly preferable from the viewpoint of high toner-removing ability, compact size, and low cost.

<Other Steps and Other Units>

—Charge-Eliminating Step and Charge-Eliminating Unit—

The charge-eliminating step is a step of applying a charge-eliminating bias to the latent electrostatic image bearing member to eliminate charges thereof, and can be preferably performed by a charge-eliminating unit. The charge-eliminating unit is not particularly limited and may be appropriately selected from known charge-eliminating devices, so long as it can apply a charge-eliminating bias to the latent electrostatic image bearing member. Example thereof includes a charge-eliminating lamp.

—Recycling Step and Recycling Unit—

The recycling step is a step of recycling each toner of the toner set removed in the cleaning step to the developing unit, and can be preferably performed by a recycling unit. The recycling unit is not particularly limited and may be, for example, known conveying units.

—Controlling Step and Controlling Unit—

The controlling step is a step of controlling each of the above steps, and can be preferably performed by a controlling unit. The controlling unit is not particularly limited and may be appropriately selected depending on the purpose, so long as it can control the operation of each of the above units. Examples thereof include devices such as a sequencer and a computer.

In the present invention, high glossiness can be achieved as follows. Firstly, in a region where high glossiness is intended, a latent electrostatic image may be formed, developed, transferred and fixed with each of the above units using the chromatic toner and the transparent toner to thereby form a first image. Then, on the first image, an additional latent electrostatic image may be formed, developed, transferred and fixed with each of the above units using the transparent toner to thereby form a second image. A region where the second image has been formed with the transparent toner contains a larger amount of the transparent toner and exhibits higher glossiness than an area where the second image has not been formed with the transparent toner because 2 passes of a fixing unit can supply sufficient quantity of heat and increase smoothness of the resultant image surface.

Meanwhile, glossiness of the chromatic toner may be selected depending on the intended purpose. When the chromatic toner has high glossiness, the transparent toner also tends to have high glossiness, and thus a difference in glossiness is decreased on the recording medium.

When the chromatic toner has low glossiness, a difference in glossiness can be easily increased on the recording medium, but high glossiness is difficult to be attained even when superposing the transparent toner. Because, in the case of the chromatic toner having low glossiness, a resin itself contained in the chromatic toner tries to return to its original state due to viscoelasticity, which causes micro-roughness on a post-fixed image surface.

Even when the chromatic toner has low glossiness, high glossiness can be achieved by thickening a layer formed with the transparent toner to thereby cover the micro-roughness caused by the chromatic toner. Accordingly, image which has various glossiness ranging from low glossiness to high glossiness can be freely formed by using the chromatic toner having low glossiness in combination with the transparent toner having high glossiness and adjusting the thickness of a layer formed with the transparent toner.

One embodiment for performing the image forming method of the present invention using the image forming apparatus of the present invention now will be explained with reference to the appended figures.

First Embodiment of Image Forming Apparatus and Image Forming Method

FIG. 1 is a schematic view of the whole image forming apparatus. Firstly, image data are submitted to an image processing portion 14, where 5 image signals corresponding to Y (yellow), M (magenta), C (cyan), Bk (black) and transparent are formed. Next, the image signals corresponding to Y, M, C, Bk and transparent are transmitted from the image processing portion 14 to an exposing unit 15. The exposing unit 15 modulates and scans 5 laser beams corresponding to Y, M, C, Bk and transparent, charges photoconductor drums (21, 22, 23, 24, 25) using charging units (51, 52, 53, 54, 55), and then sequentially forms latent electrostatic images on the photoconductor drums. Here, for example, a first photoconductor drum 21 corresponds to Bk, a second photoconductor drum 22 corresponds to Y, a third photoconductor drum 23 corresponds to M, a fourth photoconductor drum 24 corresponds to C and a fifth photoconductor drum 25 corresponds to transparent.

Then, toner images of each color are formed on the photoconductor drums (21, 22, 23, 24, 25) using developing units (31, 32, 33, 34, 35). Further, a recording medium which has been fed from a paper feeding portion 16 is conveyed on a transfer belt 70 serving as a transfer unit, during which the toner images formed on the photoconductor drums (21, 22, 23, 24, 25) are sequentially transferred onto the recording medium using transfer charges (61, 62, 63, 64, 65).

After completion of the transfer step, the recording medium is conveyed to a fixing unit 80. At the fixing unit 80, the transferred toner images are fixed on the recording medium. After completion of the transfer step, a residue toner remaining on the photoconductor drums (21, 22, 23, 24, 25) is removed by cleaning units (41, 42, 43, 44, 45). Notably, a numerical reference 17 in FIG. 1 denotes a second image forming portion.

Second Embodiment of Image Forming Apparatus and Image Forming Method

Next, the second embodiment of the image forming apparatus and the image forming method will be explained. According to the second embodiment, an image having different glossinesses region by region can be obtained.

Firstly, in the same manner as in the first embodiment of the image forming apparatus and the image forming method, image data are submitted to the image processing portion 14, where 5 image signals corresponding to Y (yellow), M (magenta), C (cyan), Bk (black) and transparent are formed.

Next, a first image partially having high glossiness is formed at the image processing portion 14. The image signals in a region where high glossiness is intended corresponding to Y, M, C, Bk and transparent are transmitted to the exposing unit 15. The exposing unit 15 modulates and scans 5 laser beams corresponding to Y, M, C, Bk and transparent, charges the photoconductor drums (21, 22, 23, 24, 25) using the charging units (51, 52, 53, 54, 55), and then sequentially forms latent electrostatic images on the photoconductor drums. Here, for example, the first photoconductor drum 21 corresponds to Bk, the second photoconductor drum 22 corresponds to Y, the third photoconductor drum 23 corresponds to M, the fourth photoconductor drum 24 corresponds to C and the fifth photoconductor drum 25 corresponds to transparent.

Then, toner images of each color are formed on the photoconductor drums (21, 22, 23, 24, 25) using the developing units (31, 32, 33, 34, 35). Further, a recording medium which has been fed from the paper feeding portion 16 is conveyed on the transfer belt 70 serving as a transfer unit, during which the toner images formed on the photoconductor drums (21, 22, 23, 24, 25) are sequentially transferred onto the recording medium using transfer charges (61, 62, 63, 64, 65).

After completion of the transfer step, the recording medium is conveyed to a fixing unit 80. At the fixing unit 80, the transferred toner images are fixed on the recording medium.

After completion of the transfer step, a residue toner remaining on the photoconductor drums (21, 22, 23, 24, 25) is removed by cleaning units (41, 42, 43, 44, 45).

Then, the recording medium on which the toner images have been fixed is conveyed to the second image forming portion 17 to form a second image.

In forming the second image, using image data processing, image signals of a region where the first image has not been formed and normal glossiness is intended are transmitted to an exposing unit 15, where images corresponding to Y, M, C and Bk (excluding transparent) are written on the photoconductor drums (21, 22, 23, 24), developed and transferred in the same manner as in the first image forming, and then again fixed by the fixing unit.

Notably, an image forming with the transparent toner may be performed, depending on the image data processing, by attaching the transparent toner to a region having a low toner-concentration on the recording medium; or by designating a region where the transparent toner is intended to be attached to thereby attach the transparent toner to an entire surface of the recording medium or only a region which is considered to as an image portion.

Figure 2:
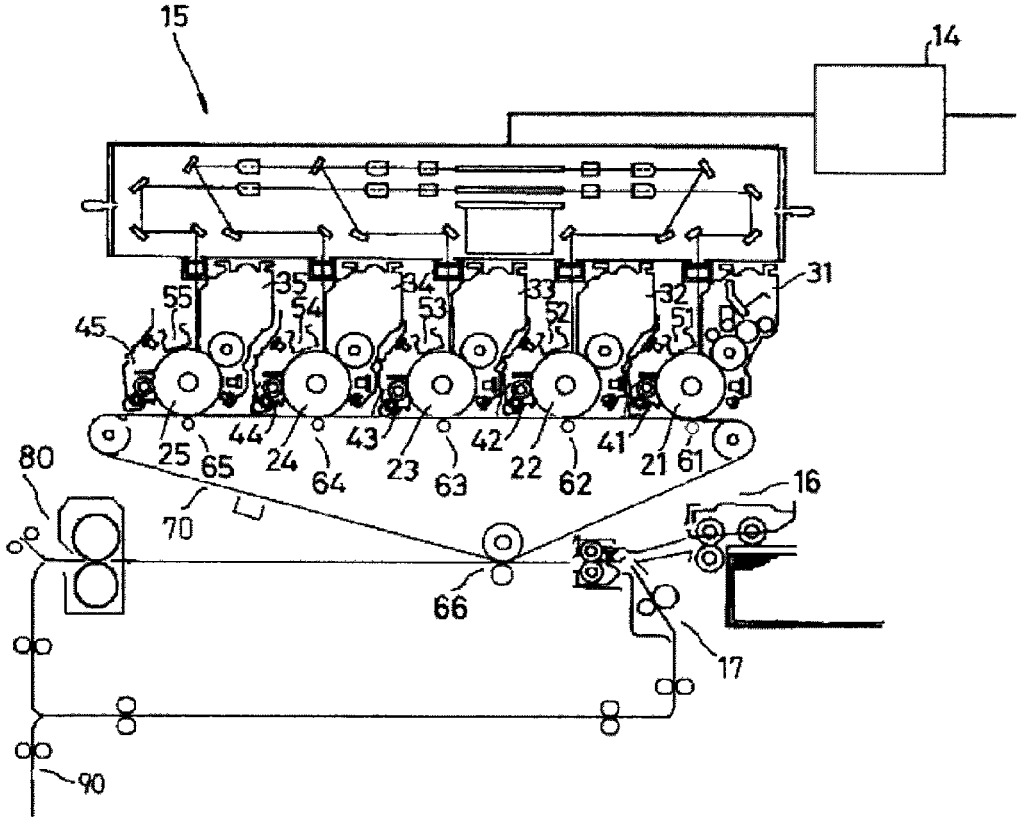
FIG. 2 is a schematic view of another example of an image forming apparatus of the present invention.

In the image forming apparatus shown in FIG. 2 and the image forming method using it, toner images formed on the photoconductor drums (21, 22, 23, 24, 25) are transferred on a transfer drum in the same manner as in the first embodiment in FIG. 1. Then, the transferred image are further transferred on the recording medium using a secondary transfer unit 66, and then fixed by the fixing unit 80.

In the first embodiment and the second embodiment, when the transparent toner is intended to be superposed thickly, the layer formed with the transparent toner placed on the transfer drum is thickened, so that it becomes difficult for the layer to be secondarily transferred. Accordingly, the transfer belt may be used instead of the transfer drum.

In the present invention, the average thickness of the layer of the transparent toner which is an uppermost layer of the transferred visible image on the recording medium is preferably 1 μm to 15 μm after fixing of the transferred visible image. When the average thickness is less than 1 μm, high glossiness may be difficult to achieve. When the average thickness is more than 15 μm, permeability is decreased and the chromatic toner may be degraded in color reproducibility.

EXAMPLES

The present invention will next be described by way of Examples, which should not be construed as limiting the present invention thereto.

<Analysis Methods>

In the following Examples and Comparative Examples, molecular weight, melting point, glass transition temperature, acid value and hydroxyl value were analyzed by the below-described methods.

<<Molecular Weight>>

The molecular weight was measured through gel permeation chromatography (GPC). Specifically, a column was conditioned in a heat chamber of 40° C. Then, tetrahydrofuran (THF) as a solvent was caused to pass through the conditioned column of the same temperature at a flow rate of 1 mL/min. Subsequently, a separately prepared THF sample solution having a sample concentration of 0.05% by mass to 0.6% by mass was applied to the column in an amount of 50 μL to 200 μL.

In the measurement of the molecular weight of the sample, the molecular weight distribution of the sample was determined based on the relationship between the logarithmic value and the count number of a calibration curve given by using several monodispersed polystyrene-standard samples. The standard polystyrene samples used for giving the calibration curve were those available from Pressure Chemical Co. or Tosoh Co., Ltd. each having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$. It is proper to use at least about 10 standard polystyrene samples for giving the calibration curve. The detector used was a refractive index (RI) detector.

<Melting Point and Glass Transition Temperature>

The melting point of the releasing agent, the melting point of the crystalline polyester resin and the glass transition temperature of the non-crystalline polyester resin were measured from a DSC curve obtained through differential scanning calorimetry (DSC). Specifically, the DSC curve was obtained using TA-60WS and DSC-60 (these products are of Shimadzu Corporation, Ltd.) under the following measurement conditions.

[Measurement Conditions]

Sample container: aluminum sample pan (with a lid)
Sample amount: 5 mg
Reference: aluminum sample pan (alumina: 10 mg)
Atmosphere: nitrogen (flow rate: 50 mL/min)
Temperature condition:
- Start temperature: 20° C.
- Heating rate: 10° C./min
- Finish temperature: 150° C.
- Hold time: 0
- Cooling rate: 10° C./min
- Finish temperature: 20° C.
- Hold time: 0
- Heating rate: 10° C./min
- Finish temperature: 150° C.

The measured results were analyzed using data analysis software TA-60, version 1.52 (product of Shimadzu Corporation, Ltd.).

The analysis was performed by appointing a range of ±5° C. around a point presenting the maximum peak of a DrDSC curve, which was a differential curve of the DSC curve in the second heating, and by determining the peak temperature using a peak analysis function of the data analysis software. Then, the maximum endothermic temperature of the DSC curve was determined in the range of the peak temperatures +5° C. and −5° C. in the DSC curve using the peak analysis function of the data analysis software. The temperature presented here corresponds to the melting point of the sample.

The glass transition temperature (Tg) was defined as an intersection point between the DSC curve and a straight line, which passed through an intermediate point between baselines before and after appearance of the exothermic peak of the main peak in the temperature range of 40° C. to 100° C. in the heating.

<<Acid Value>>

The acid value was measured according to the method of JIS K0070-1992 in the following manner.

A measurement sample (0.5 g) (0.3 g as an ethyl acetate soluble matter) was added to toluene (120 mL), followed by dissolving under stirring at 23° C. for about 10 hours. Then, ethanol (30 mL) was added to the resultant solution to prepare a sample solution. Note that, when the measurement sample was not dissolved, another solvent such as dioxane or tetrahydrofuran was used as a solvent. Furthermore, a potentiometric automatic titrator (DL-53 Titrator, product of Mettler-Toledo K.K.) and an electrode (DG113-SC, product of Mettler-Toledo K.K.) were used to measure the acid value at 23° C. and analyze it using analysis software (LabX Light Version 1.00.000). Note that, the calibration for the apparatus was performed using a solvent mixture of toluene (120 mL) and ethanol (30 mL). The measurement conditions are as follows.

[Measurement Conditions]

| | |
|---|---|
| Stirring conditions | |
| Stirring speed [%] | 25 |
| Stirring time [s] | 15 |
| Equilibrium titration conditions | |
| Titrant | $CH_3ONa$ |
| Concentration [mol/L] | 0.1 |
| Electrode | DG115 |
| Unit of measurement | mV |
| Predispensing of titrant | |
| Volume [mL] | 1.0 |
| Wait time [s] | 0 |
| Mode of titrant addition: Dynamic | |
| dE (set) [mV] | 8.0 |
| dV (min) [mL] | 0.03 |
| dV (max) [mL] | 0.5 |
| Measurement mode: Equilibrium titration | |
| dE [mV] | 0.5 |
| dt [s] | 1.0 |
| t (min) [s] | 2.0 |
| t (max) [s] | 20.0 |
| Recognition conditions | |
| Threshold | 100.0 |
| Steepest jump only | No |
| Range | No |
| Frequency | None |
| Termination conditions of measurement | |
| Maximum volume [mL] of titrant | 10.0 |
| at potential | No |
| at slope | No |
| after number EQPs | Yes |
| n | 1 |
| Comb. termination conditions | No |
| Evaluation conditions | |
| Procedure | Standard |
| Potential 1 | No |
| Potential 2 | No |
| Stop for reevaluation | No |

The acid value of the crystalline resin can be calculated with the above apparatus, specifically as follows. The prepared sample solution was titrated with a pre-standardized 0.1N potassium hydroxide/alcohol solution. The acid value was calculated from the following equation:

$$\text{Acid value[KOHmg/g]} = \text{titration value[mL]} \times N \times 56.1 \text{ [mg/mL]} / \text{mass of measurement sample[g]}$$

where "N" is a factor of 0.1N potassium hydroxide/alcohol solution.

<<Hydroxyl Value>>

The hydroxyl value was measured according to the method of JIS K0070-1966 in the following manner.

Specifically, 0.5 g of a measurement sample was accurately weighed in a 100 mL measuring flask, and then 5 mL of an acetylation reagent was added thereto. Next, the measuring flask was heated for 1 hour to 2 hours in a hot water bath set to 100° C.±5° C., and was then taken out from the hot water bath and left to cool. In addition, water was added to the measuring flask, which was then shaken to decompose acetic anhydride. Next, for completely decomposing acetic anhydride, the flask was heated again in the hot water bath for 10 min or more and then left to cool. Thereafter, the wall of the flask was thoroughly washed with an organic solvent.

Furthermore, a potentiometric automatic titrator (DL-53 Titrator, product of Mettler-Toledo K.K.) and an electrode (DG113-SC, product of Mettler-Toledo K.K.) were used to measure the hydroxyl value at 23° C. and analyze it using analysis software (LabX Light Version 1.00.000). Note that, the calibration for the above potentiometric automatic titrator was performed using a solvent mixture of toluene (120 mL) and ethanol (30 mL). The measurement conditions for the hydroxyl value were the same as those for the acid value as described above.

Production Example 1 of Chromatic Toner

—Synthesis of Non-Crystalline Polyester Resin 1—

A reaction container equipped with a condenser, a stirrer and a nitrogen-introducing pipe was charged with bisphenol A propylene oxide 3 mole adduct (781 parts by mass), terephthalic acid (218 parts by mass), adipic acid (48 parts by mass), and dibutyltin oxide (2 parts by mass). The resultant mixture was allowed to react under normal pressure at 230° C. for 8 hours, and further react at a reduced pressure of 10 mmHg to 15 mmHg for 5 hours. Then, trimellitic anhydride (45 parts by mass) was added to the reaction container, followed by reaction under normal pressure at 180° C. for 2 hours, to thereby obtain [non-crystalline polyester resin 1].

The obtained [non-crystalline polyester resin 1] was found to have a number average molecular weight of 1,900, a weight average molecular weight of 4,400, a glass transition temperature (Tg) of 43° C., and an acid value of 25 mgKOH/g.

—Synthesis of Crystalline Polyester Resin 1—

A 5 L four-neck flask equipped with a nitrogen-introducing pipe, a drainpipe, a stirrer and a thermocouple was charged with 1,10-decanedioic acid (2,120 g), 1,8-octanediol (1,000 g), 1,4-butanediol (1,520 g) and hydroquinone (3.9 g), followed by reaction at 180° C. for 10 hours. Thereafter, the reaction mixture was allowed to react at 200° C. for 3 hours and further react at 8.3 kPa for 2 hours, to thereby obtain [crystalline polyester resin 1].

The obtained [crystalline polyester resin 1] was found to have a weight average molecular weight of 15,000, a number average molecular weight of 4,000, and a melting point of 67° C.

—Synthesis of Prepolymer—

A reaction container equipped with a condenser, a stirrer and a nitrogen-introducing pipe was charged with bisphenol A ethylene oxide 2 mole adduct (682 parts by mass), bisphenol A propylene oxide 2 mole adduct (81 parts by mass), terephthalic acid (283 parts by mass), trimellitic anhydride (22 parts by mass) and dibutyltin oxide (2 parts by mass). The resultant mixture was allowed to react under normal pressure at 230° C. for 8 hours and further react at a reduced pressure of 10 mmHg to 15 mmHg for 6 hours, to thereby obtain [intermediate polyester resin 1].

The [intermediate polyester resin 1] was found to have a number average molecular weight of 2,100, a weight average molecular weight of 9,000, a glass transition temperature (Tg) of 58° C., an acid value of 0.5 mgKOH/g and a hydroxyl value of 51 mgKOH/g.

Next, a reaction container equipped with a condenser, a stirrer and a nitrogen-introducing pipe was charged with the [intermediate polyester resin 1] (410 parts by mass), isophorone diisocyanate (89 parts by mass) and ethyl acetate (500 parts by mass), followed by reaction at 100° C. for 5 hours, to thereby obtain [prepolymer 1]. The amount of free isocyanate contained in the obtained [prepolymer 1] was found to be 1.53% by mass.

—Synthesis of Ketimine—

A reaction container equipped with a stirring rod and a thermometer was charged with isophorone diamine (170 parts by mass) and methyl ethyl ketone (75 parts by mass), followed by reaction at 50° C. for 5 hours, to thereby obtain [ketimine compound 1]. The amine value of the obtained [ketimine compound 1] was found to be 418.

—Preparation of Fine Organic Particle Emulsion—

A reaction container to which a stirring rod and a thermometer had been set was charged with water (683 parts by mass), a sodium salt of sulfuric acid ester of methacrylic acid-ethylene oxide adduct (ELEMINOL RS-30, product of Sanyo Chemical Industries, Ltd.) (11 parts by mass), styrene (138 parts by mass), methacrylic acid (138 parts by mass) and ammonium persulfate (1 part by mass), and the resultant mixture was stirred at 400 rpm for 15 min to prepare a white emulsion. The obtained emulsion was heated to 75° C. and allowed to react for 5 hours. Subsequently, a 1% by mass aqueous ammonium persulfate solution (30 parts by mass) was added to the reaction mixture, followed by aging at 75° C. for 5 hours, to thereby prepare an aqueous dispersion liquid [fine particle dispersion liquid 1] of a vinyl resin (a copolymer of styrene-methacrylic acid-sodium salt of sulfuric acid ester of methacrylic acid ethylene oxide adduct).

The obtained [fine particle dispersion liquid 1] was measured for volume average particle diameter with a laser diffraction/scattering particle size analyzer (LA-920, product of Horiba, Ltd.), and was found to have a volume average particle diameter of 0.14 μm.

—Preparation of Aqueous Phase—

Water (990 parts by mass), the [fine particle dispersion liquid 1] (80 parts by mass), a 48.5% by mass aqueous solution of sodium dodecyldiphenyl ether disulfonate (ELEMINOL MON-7, product of Sanyo Chemical Industries Ltd.) (40 parts by mass) and ethyl acetate (90 parts by mass) were mixed together and stirred to obtain an opaque white liquid, which was used as [aqueous phase 1].

—Preparation of Masterbatch—

Carbon black (REGAL 400R, product of Cabot Corporation) (40 parts by mass), a polyester resin (60 parts by mass) (RS-801, product of Sanyo Chemical Industries, Ltd., acid value: 10 mgKOH/g, weight average molecular weight: 20,000, glass transition temperature (Tg): 64° C.) and water (30 parts by mass) were mixed together using HENSCHEL MIXER, to thereby obtain a mixture containing pigment aggregates impregnated with water. The obtained mixture was kneaded for 45 min with a two-roll mill whose roll surface temperature had been adjusted to 130° C. The kneaded product was pulverized with a pulverizer so as to have a size of 1 mm, whereby [masterbatch 1] was obtained.

—Preparation of Oil Phase—

A container to which a stirring rod and a thermometer had been set was charged with the [non-crystalline polyester resin 1] (425.6 parts by mass), carnauba wax (product of TOAGOSEI CO., LTD., 48.4 parts by mass) as a releasing agent, the [masterbatch 1] (145.7 parts by mass), a charge-controlling agent (CCA, salycilic acid metal complex, BONTRON E-84, product of Orient Chemical Industries, Ltd.) (20 parts by mass) and ethyl acetate (400 parts by mass), and the mixture was heated to 80° C. under stirring. The resultant mixture was maintained at 80° C. for 5 hours and then cooled to 30° C. for 1 hour. Subsequently, the [crystalline polyester resin 1] (64.5 parts by mass) was charged into the reaction container, and ethyl acetate was charged thereinto so that the solid content concentration calculated from the amounts of all the raw materials charged became 53% by mass, followed by mixing for 1 hour, to thereby prepare [raw material solution 1].

The [raw material solution 1] (1,328 parts by mass) was transferred into a container, and was treated with a beads mill (ULTRA VISCOMILL, product of AIMEX CO., Ltd.) under the following conditions: a liquid feed rate of 1 kg/hr, disc circumferential velocity of 6 m/s, 0.5 mm (in diameter)-zirconia beads packed to 80% by volume, and 3 passes, to thereby prepare [oil phase dispersion liquid 1].

The solid content concentration of the obtained [oil phase dispersion liquid 1] was found to be 53.2% by mass (150° C., 60 min).

—Emulsification—

The [oil phase dispersion liquid 1] (664 parts by mass), the [prepolymer 1] (51 parts by mass), the [ketimine compound 1] (6.7 parts by mass) were placed in a container, followed by mixing for 1 min at 5,000 rpm with a TK homomixer (product of PRIMIX Corporation, Ltd.). Thereafter, the [aqueous phase 1] (1,200 parts by mass) was added to the container, and the resultant mixture was mixed with the TK homomixer at 13,000 rpm for 3 min, to thereby obtain [emulsified slurry 1].

—Deformation and Desolvation—

A container to which a stirrer and a thermometer had been set was charged with the [emulsified slurry 1], which was left to stand still at 15° C. for 1 hour. Thereafter, the [emulsified slurry 1] was desolvated at 30° C. for 1 hour to obtain [chromatic dispersion slurry 1].

The obtained [chromatic dispersion slurry 1] was found to have a volume average particle diameter of 5.52 μm and a number average particle diameter of 4.74 μm. Note that, the volume average particle diameter and the number average particle diameter of the [chromatic dispersion slurry 1] were measured with COULTER MULTISIZER III (product of Nikkaki Co., Ltd.).

—Washing and Drying—

The obtained [chromatic dispersion slurry 1] (100 parts by mass) was filtrated under reduced pressure and then subjected twice to a series of the following treatments (1) to (4), to thereby obtain [chromatic filtration cake 1]:

(1); ion-exchanged water (100 parts by mass) was added to the filtration cake, followed by mixing (at 12,000 rpm for 10 min) with a TK homomixer (product of Tokushu Kika Kogyo Co., Ltd.) and then filtration;

(2): 10% by mass aqueous sodium hydroxide solution (100 parts by mass) was added to the filtration cake obtained in (1) above, followed by mixing (at 12,000 rpm for 30 min) with a TK homomixer and then filtration under reduced pressure;

(3): 10% by mass hydrochloric acid (100 parts by mass) was added to the filtration cake obtained in (2) above, followed by mixing (at 12,000 rpm for 10 min) with a TK homomixer and then filtration; and (4): ion-exchanged water (300 parts by mass) was added to the filtration cake obtained in (3) above, followed by mixing (at 12,000 rpm for 10 min) with a TK homomixer and then filtration.

The obtained [chromatic dispersion slurry 1] was dried with an air-circulating drier at 45° C. for 48 hours, and then was caused to pass through a sieve with a mesh size of 75 μm, to thereby prepare [chromatic toner base particles 1].

The obtained chromatic toner base particles (100 parts by mass) were mixed with hydrophobic silica (0.7 parts by mass) and hydrophobic titanium oxide (0.3 parts by mass) using HENSCHEL MIXER (product of NIPPON COKE & ENGINEERING. CO., LTD.), to thereby obtain [chromatic toner 1].

Production Example 2 of Chromatic Toner

[Chromatic toner 2] was obtained in the same manner as in Production Example 1 of chromatic toner except that the amount of the [non-crystalline polyester resin 1] charged in the preparation of the oil phase was changed to 430.6 parts by mass and that the amount of the [prepolymer 1] charged in the emulsification was changed to 43.8 parts by mass.

Production Example 3 of Chromatic Toner

[Chromatic toner 3] was obtained in the same manner as in Production Example 1 of chromatic toner except that the amount of the [non-crystalline polyester resin 1] charged in the preparation of the oil phase was changed to 405.4 parts by mass and that the amount of the [prepolymer 1] charged in the emulsification was changed to 56.3 parts by mass.

Production Example 4 of Chromatic Toner

[Chromatic toner 4] was obtained in the same manner as in Production Example 1 of chromatic toner except that the amount of the [non-crystalline polyester resin 1] charged in the preparation of the oil phase was changed to 385.3 parts by mass and that the amount of the [crystalline polyester resin 1] charged in the preparation of the oil phase was changed to 104.8 parts by mass.

Production Example 5 of Chromatic Toner

[Chromatic toner 5] was obtained in the same manner as in Production Example 1 of chromatic toner except that the amount of the [non-crystalline polyester resin 1] charged in the preparation of the oil phase was changed to 449.8 parts by mass and that the amount of the [crystalline polyester resin 1] charged in the preparation of the oil phase was changed to 40.3 parts by mass.

Production Example 6 of Chromatic Toner

[Chromatic toner 6] was obtained in the same manner as in Production Example 1 of chromatic toner except that the amount of the [non-crystalline polyester resin 1] charged in the preparation of the oil phase was changed to 433.6 parts by mass and that the amount of the carnauba wax charged in the preparation of the oil phase was changed to 40.3 parts by mass.

Production Example 7 of Chromatic Toner

[Chromatic toner 7] was obtained in the same manner as in Production Example 1 of chromatic toner except that the amount of the [non-crystalline polyester resin 1] charged in the preparation of the oil phase was changed to 401.4 parts by mass and that the amount of the carnauba wax charged in the preparation of the oil phase was changed to 72.5 parts by mass.

Production Example 8 of Chromatic Toner

[Chromatic toner 8] was obtained in the same manner as in Production Example 1 of chromatic toner except that the amount of the [non-crystalline polyester resin 1] charged in the preparation of the oil phase was changed to 435.8 parts by mass and that the amount of the [prepolymer 1] charged in the emulsification was changed to 36.2 parts by mass.

Production Example 9 of Chromatic Toner

[Chromatic toner 9] was obtained in the same manner as in Production Example 1 of chromatic toner except that the amount of the [non-crystalline polyester resin 1] charged in the preparation of the oil phase was changed to 420.3 parts by mass, that the amount of the [crystalline polyester resin 1] charged in the preparation of the oil phase was changed to 82.8 parts by mass, and that the amount of the [prepolymer 1] charged in the emulsification was changed to 62.1 parts by mass.

Production Example 10 of Chromatic Toner

[Chromatic toner 10] was obtained in the same manner as in Production Example 1 of chromatic toner except that the amount of the [non-crystalline polyester resin 1] charged in the preparation of the oil phase was changed to 469.5 parts by mass, that the amount of the [crystalline polyester resin 1] charged in the preparation of the oil phase was changed to 23.8 parts by mass, and that the amount of the [prepolymer 1] charged in the emulsification was changed to 45 parts by mass.

Production Example 11 of Chromatic Toner

[Chromatic toner 11] was obtained in the same manner as in Production Example 1 of chromatic toner except that the amount of the [non-crystalline polyester resin 1] charged in the preparation of the oil phase was changed to 287.1 parts by mass, that the amount of the [crystalline polyester resin 1] charged in the preparation of the oil phase was changed to 181.5 parts by mass, and that the amount of the [prepolymer 1] charged in the emulsification was changed to 60.5 parts by mass.

Production Example 12 of Chromatic Toner

[Chromatic toner 12] was obtained in the same manner as in Production Example 1 of chromatic toner except that the amount of the [non-crystalline polyester resin 1] charged in the preparation of the oil phase was changed to 482 parts by mass, that the amount of the [crystalline polyester resin 1] charged in the preparation of the oil phase was changed to 52.4 parts by mass, and that the amount of the carnauba wax in the preparation of the oil phase was charged to 4 parts by mass.

Production Example 13 of Chromatic Toner

[Chromatic toner 13] was obtained in the same manner as in Production Example 1 of chromatic toner except that the amount of the [non-crystalline polyester resin 1] charged in the preparation of the oil phase was changed to 369.2 parts by mass and that the amount of the carnauba wax in the preparation of the oil phase was charged to 104.8 parts by mass.

Production Example 14 of Chromatic Toner

—Preparation of Crystalline Polyester Dispersion Liquid 1—

The [crystalline polyester resin 1] (180 parts by mass) and deionized (585 parts by mass) were added to a stainless steel beaker, which was then immersed in a hot bath and heated to 95° C. At the time when the [crystalline polyester resin 1] melted and the mixture became transparent, the mixture was stirred at 10,000 rpm using T.K. ROBOMIX (product of PRIMIX Corporation, Ltd.) and adjusted in pH to 7.0 with 1% by mass aqueous ammonia. Next, the resultant mixture was emulsified and dispersed while diluted aqueous solution (20 parts by mass) containing an anionic surfactant (0.8 parts by mass, product of DAI-ICHI KOGYO SEIYAKU CO., LTD., NEOGEN R-K) and a nonionic surfactant (0.2 parts by mass, product of DAI-ICHI KOGYO SEIYAKU CO., LTD., EMULGEN950) was being added dropwise thereto, to thereby prepare [crystalline polyester dispersion liquid 1] (solid content: 11.9% by mass) having a volume average particle diameter of 0.8 μm.

—Preparation of Non-Crystalline Polyester Dispersion Liquid 1—

[Non-crystalline polyester dispersion liquid 1] (solid content: 12.3% by mass) was prepared in the same manner as in the preparation of the crystalline polyester dispersion liquid 1 except that the [crystalline polyester resin 1] was changed to [non-crystalline polyester resin 2] synthesized in the following manner.

—Synthesis of Non-Crystalline Polyester Resin 2—

A two-neck flask, which had been dried with heating, was charged with polyoxypropylene(2,2)-2,2-bis(4-hydroxyphenyl)propane (780 parts by mass), polyoxyethylene(2,2)-2,2-bis(4-hydroxyphenyl)propane (18 parts by mass), terephthalic acid (47 parts by mass), fumaric acid (24 parts by mass), n-dodecenylsuccinic acid (24 parts by mass) and dibutyltin oxide as a catalyst. Nitrogen gas was introduced to the flask to keep the atmosphere thereof inactive and the temperature therein was increased. The compounds were allowed to undergo co-condensation polymerization at 230° C. for 10 hours. The flask was gradually reduced in pressure at 230° C. to synthesize [non-crystalline polyester resin 2].

The obtained [non-crystalline polyester resin 2] was found to have a number average molecular weight of 5,800, a weight average molecular weight of 13,400, a glass transition temperature (Tg) of 55° C., and an acid value of 16 mgKOH/g.

—Preparation of Pigment Dispersion Liquid—

Carbon black (REGAL 400R, product of Cabot Corporation) (20 parts by mass), ion-exchanged water (80 parts by mass) and an anionic surfactant (4.0 parts by mass, product of DAI-ICHI KOGYO SEIYAKU CO., LTD., NEOGEN R-K) were added to a container. The pigment was dispersed using a beads mill (ULTRA VISCOMILL, product of AIMEX CO., Ltd.) under the following conditions: a liquid feed rate of 1 kg/hr, disc circumferential velocity of 6 m/s, 0.3 mm (in diameter)-zirconia beads packed to 80% by volume, and 15 passes, to thereby prepare [pigment dispersion liquid] (solid content: 19.8% by mass) having a volume average particle diameter of 0.07 μm.

—Preparation of Wax Dispersion Liquid—

Carnauba wax (product of TOAGOSEI CO., LTD., 20 parts by mass), ion-exchanged water (80 parts by mass) and an anionic surfactant (4 parts by mass, product of DAI-ICHI KOGYO SEIYAKU CO., LTD., NEOGEN R-K) were mixed together. The resultant mixture was heated to 95° C. under stirring and maintained for 1 hour. After cooling, the wax was dispersed using a beads mill (ULTRA VISCOMILL, product of AIMEX CO., Ltd.) under the following conditions: a liquid feed rate of 1 kg/hr, disc circumferential velocity of 6 m/s, 0.3 mm (in diameter)-zirconia beads packed to 80% by volume, and 25 passes, to thereby prepare [wax dispersion liquid] (solid content: 20.8% by mass) having a volume average particle diameter of 0.15 μm.

—Preparation of Charge-Controlling Agent (CCA) Dispersion Liquid—

A charge-controlling agent (CCA, salycilic acid metal complex, BONTRON E-84, product of Orient Chemical Industries, Ltd.) (5 parts by mass), ion-exchanged water (95 parts by mass) and an anionic surfactant (0.5 parts by mass, product of DAI-ICHI KOGYO SEIYAKU CO., LTD., NEOGEN R-K) were added to a container. The charge-controlling agent was dispersed using a beads mill (ULTRA VISCOMILL, product of AIMEX CO., Ltd.) under the following conditions: a liquid feed rate of 1 kg/hr, disc circumferential velocity of 6 m/s, 0.3 mm (in diameter)-zirconia beads packed to 80% by volume, and 5 passes, to thereby prepare [charge-controlling agent (CCA) dispersion liquid] (solid content: 4.8% by mass).

—Preparation of Toner—

The above pigment dispersion liquid: 40.8 parts by mass

The above charge-controlling agent (CCA) dispersion liquid: 20.8 parts by mass

The above crystalline polyester dispersion liquid 1:67.2 parts by mass

The above non-crystalline polyester dispersion liquid 1:634.1 parts by mass

The above wax dispersion liquid: 28.8 parts by mass

These liquids were mixed together and stirred for 2 hours with DISPER (product of IKA Co., Ltd.) at a constant temperature of 25° C. Next, the obtained mixture was heated to 60° C. and adjusted in pH to 7.0 with ammonia. Furthermore, the resultant dispersion liquid was heated to 90° C. and maintained at the same temperature for 6 hours, to thereby obtain [chromatic dispersion slurry 2].

Next, [chromatic toner 14] was obtained in the same manner as in Production Example 1 of chromatic toner except that the [chromatic dispersion slurry 1] in the washing and drying was changed to the [chromatic dispersion slurry 2].

Production Example 15 of Chromatic Toner

The above crystalline polyester resin 1:6.4 parts by mass

The above non-crystalline polyester resin 2:86 parts by mass

The above carbon black (product of Cabot Corporation, REGAL 400R): 8.7 parts by mass The above charge-controlling agent (CCA, salycilic acid metal complex, BONTRON E-84, product of Orient Chemical Industries, Ltd.): 1 part by mass Carnauba wax (product of TOAGOSEI CO., LTD.): 6.5 parts by mass The above-listed toner raw materials were thoroughly mixed together using SUPER MIXER (SMV-200, product of KAWATA MFG Co., Ltd.), to thereby obtain a toner powder raw material mixture. The toner powder raw material mixture was fed to a raw material-feeding hopper of BUSS COKNEADER (TCS-100, product of BUSS Co., Ltd.) and kneaded at a feeding rate of 120 kg/hour.

The obtained kneaded product was calendered and cooled using a double head cooler. The treated product was coarsely pulverized with a hammer mill and then finely pulverized with a jet airflow-type mill (I-20 JET MILL, product of Nippon Pneumatic Co.). The pulverized product was treated with a wind-driven classifier (DS-20.DS-10 classifier, product of Nippon Pneumatic Co.) to classify fine powder. The resultant product was left to stand at 50° C. for 24 hours for annealing, to thereby obtain [chromatic toner 15].

Production Example 16 of Chromatic Toner

[Chromatic toner 16] was obtained in the same manner as in Production Example 1 of chromatic toner except that the amount of the [non-crystalline polyester resin 1] charged in the preparation of the oil phase was changed to 441.6 parts by mass and that the amount of the [prepolymer 1] charged in the emulsification was changed to 27.8 parts by mass.

Production Example 17 of Chromatic Toner

[Chromatic toner 17] was obtained in the same manner as in Production Example 1 of chromatic toner except that the amount of the [non-crystalline polyester resin 1] charged in the preparation of the oil phase was changed to 327.1 parts by mass, the amount of the [crystalline polyester resin 1] charged in the preparation of the oil phase was changed to 170.8 parts by mass, and that the amount of the [prepolymer 1] charged in the emulsification was changed to 36.2 parts by mass.

Production Example 18 of Chromatic Toner

[Chromatic toner 18] was obtained in the same manner as in Production Example 1 of chromatic toner except that the amount of the [non-crystalline polyester resin 1] charged in the preparation of the oil phase was changed to 497.9 parts by mass, the amount of the [crystalline polyester resin 1] charged in the preparation of the oil phase was changed to 0 parts by mass, and that the amount of the [prepolymer 1] charged in the emulsification was changed to 36.2 parts by mass.

Production Example 19 of Chromatic Toner

[Chromatic toner 19] was obtained in the same manner as in Production Example 1 of chromatic toner except that the amount of the [non-crystalline polyester resin 1] charged in the preparation of the oil phase was changed to 455.9 parts by mass, the amount of the [crystalline polyester resin 1] charged in the preparation of the oil phase was changed to 57.5 parts by mass, and that the amount of the [prepolymer 1] charged in the emulsification was changed to 7.2 parts by mass.

Production Example 20 of Chromatic Toner

[Chromatic toner 20] was obtained in the same manner as in Production Example 1 of chromatic toner except that the amount of the [non-crystalline polyester resin 1] charged in the preparation of the oil phase was changed to 471.8 parts by mass and that the amount of the [prepolymer 1] charged in the emulsification was changed to 71.7 parts by mass.

Production Example 21 of Chromatic Toner

[Chromatic toner 21] was obtained in the same manner as in Production Example 1 of chromatic toner except that the amount of the [non-crystalline polyester resin 1] charged in the preparation of the oil phase was changed to 475.3 parts by mass and that the amount of the [prepolymer 1] charged in the emulsification was changed to 31.2 parts by mass.

Production Example 22 of Chromatic Toner

[Chromatic toner 22] was obtained in the same manner as in Production Example 1 of chromatic toner except that the amount of the [non-crystalline polyester resin 1] charged in the preparation of the oil phase was changed to 452.8 parts by mass and that the amount of the [prepolymer 1] charged in the emulsification was changed to 69.1 parts by mass.

Tables 1-1 and 1-2 present: the amounts of the crystalline polyester resin, the wax serving as a releasing agent, and the prepolymer which were calculated from their charged amounts in Production Examples 1 to 22 of chromatic toners; the amount of tetrahydrofuran (THF) insoluble matters measured by the following method; and the volume average particle diameters and the ratios (Dv/Dn) of the chromatic toners.

<<Amount of Tetrahydrofuran (THF) Insoluble Matter>>

Each (3 g) of the chromatic toners of the toner sets was weighed and defined as A (g). Next, the chromatic toner was charged into cylindrical filter paper (inner diameter: 24 mm) having a known mass, and the cylindrical filter paper was set to an extraction tube. Then, tetrahydrofuran (THF) (200 mL) was added to a flask. The flask equipped with a condenser was immersed in a mantle heater, and the THF was refluxed at 60° C. The THF was dropped to the chromatic toner through the condenser, and THF soluble matter of the chromatic toner was extracted in the flask. After extraction at 60° C. for 8 hours, the THF serving as a liquid for extraction was evaporated under reduced pressure, and the residue remaining on the cylindrical filter paper (THF insoluble matter) was weighed. The obtained value was defined as B (g). The above-described measurement for the values A and B was performed 5 times in total. Each of the values A and B was an average of 5 values obtained in the measurements performed 5 times.

The thus-obtained A and B were assigned to the following formula to calculate an amount of THF insoluble matter (% by mass).

$$\text{Amount of THF insoluble matter(\% by mass)}=(B/A)\times 100$$

<<Volume Average Particle Diameter Dv and Ratio (Dv/Dn)>>

The volume average particle diameter (Dv), number average particle diameter (Dn) and ratio (Dv/Dn) of the chromatic toners in the toner sets were obtained from their particle size distribution measured using COULTER MULTISIZER III (product of Beckman Coulter, Inc.) connected to personal computer PC9801 (product of NEC Co.) via an interface (product of The Institute of Japanese Union of Scientists & Engineers), which outputs number and volume distributions.

Specifically, first, a surfactant (alkylbenzene sulfonate) (0.1 mL to 5 mL) was added as a dispersing agent to an electrolyte solution (100 mL to 150 mL). Here, the electrolyte solution was ISOTON-II (product of Beckman Coulter, Inc.) which is a 1% by mass aqueous solution prepared using 1st grade sodium chloride.

Subsequently, a sample (2 mg to 20 mg) was suspended in the above-obtained electrolyte solution. The resultant electrolyte solution was dispersed with an ultrasonic wave disperser for 1 min to 3 min. The thus-obtained dispersion liquid was analyzed using an aperture of 100 μm to measure the number and volume of the chromatic toner. Then, the volume particle size distribution and number particle size distribution were calculated from the obtained values.

In this measurement, 13 channels were used: 2.00 μm (inclusive) to 2.52 μm (exclusive); 2.52 μm (inclusive) to 3.17 μm (exclusive); 3.17 μm (inclusive) to 4.00 μm (exclusive); 4.00 μm (inclusive) to 5.04 μm (exclusive); 5.04 μm (inclusive) to 6.35 μm (exclusive); 6.35 μm (inclusive) to 8.00 μm (exclusive); 8.00 μm (inclusive) to 10.08 μm (exclusive); 10.08 μm (inclusive) to 12.70 μm (exclusive); 12.70 μm (inclusive) to 16.00 μm (exclusive); 16.00 μm (inclusive) to 20.20 μm (exclusive); 20.20 μm (inclusive) to 25.40 μm (exclusive); 25.40 μm (inclusive) to 32.00 μm (exclusive); and 32.00 μm (inclusive) to 40.30 μm (exclusive); i.e., particles having a particle diameter of 2.00 μm (inclusive) to 40.30 μm (exclusive) were subjected to the measurement.

TABLE 1-1

| | Amount of wax (% by mass) | Amount of crystalline polyester resin (% by mass) | Amount of THF insoluble matter (% by mass) | Volume average particle diameter Dv (μm) | Ratio (Dv/Dn) |
|---|---|---|---|---|---|
| Chromatic toner 1 | 6 | 8 | 19.1 | 5.1 | 1.15 |
| Chromatic toner 2 | 6 | 8 | 16.6 | 5.0 | 1.17 |
| Chromatic toner 3 | 6 | 8 | 20.7 | 4.8 | 1.19 |
| Chromatic toner 4 | 6 | 13 | 19.3 | 5.5 | 1.14 |
| Chromatic toner 5 | 6 | 5 | 18.6 | 4.5 | 1.15 |
| Chromatic toner 6 | 5 | 8 | 18.4 | 5.7 | 1.18 |
| Chromatic toner 7 | 9 | 8 | 18.4 | 5.5 | 1.17 |
| Chromatic toner 8 | 6 | 8 | 14.0 | 5.1 | 1.16 |
| Chromatic toner 9 | 6 | 10 | 22.5 | 5.4 | 1.15 |
| Chromatic toner 10 | 6 | 3 | 17.2 | 5.2 | 1.14 |
| Chromatic toner 11 | 8 | 20 | 22.1 | 5.8 | 1.23 |
| Chromatic toner 12 | 0.5 | 6.5 | 19.3 | 5.1 | 1.17 |
| Chromatic toner 13 | 13 | 8 | 19.0 | 5.2 | 1.21 |
| Chromatic toner 14 | 6 | 8 | 18.2 | 6.1 | 1.25 |
| Chromatic toner 15 | 6 | 8 | 17.3 | 8.2 | 1.32 |
| Chromatic toner 16 | 6 | 8 | 11.4 | 5.4 | 1.14 |
| Chromatic toner 17 | 6 | 22 | 14.2 | 5.8 | 1.21 |
| Chromatic toner 18 | 6 | 0 | 14.1 | 5.1 | 1.19 |
| Chromatic toner 19 | 6 | 8 | 3.1 | 4.8 | 1.15 |
| Chromatic toner 20 | 6 | 8 | 25.4 | 5.0 | 1.18 |
| Chromatic toner 21 | 6 | 8 | 12.2 | 4.5 | 1.16 |
| Chromatic toner 22 | 6 | 8 | 24.6 | 5.0 | 1.18 |

TABLE 1-2

| | Amount of prepolymer charged (parts by mass) | Amount of prepolymer charged (% by mass) |
|---|---|---|
| Chromatic toner 1 | 51.0 | 12.5 |
| Chromatic toner 2 | 43.8 | 11.0 |
| Chromatic toner 3 | 56.3 | 14.0 |
| Chromatic toner 4 | 51.0 | 12.5 |
| Chromatic toner 5 | 51.0 | 12.5 |
| Chromatic toner 6 | 51.0 | 12.5 |
| Chromatic toner 7 | 51.0 | 12.5 |
| Chromatic toner 8 | 36.2 | 9.0 |
| Chromatic toner 9 | 62.1 | 15.0 |
| Chromatic toner 10 | 45.0 | 11.5 |
| Chromatic toner 11 | 60.5 | 15.0 |
| Chromatic toner 12 | 51.0 | 12.5 |
| Chromatic toner 13 | 51.0 | 12.5 |
| Chromatic toner 14 | — | — |
| Chromatic toner 15 | — | — |
| Chromatic toner 16 | 27.8 | 7.3 |
| Chromatic toner 17 | 36.2 | 9.3 |
| Chromatic toner 18 | 36.2 | 9.3 |
| Chromatic toner 19 | 7.2 | 2.0 |
| Chromatic toner 20 | 71.7 | 17.0 |
| Chromatic toner 21 | 31.2 | 8.1 |
| Chromatic toner 22 | 69.1 | 16.4 |

*The amount of prepolymer in Table 1-2 is the same as that of the modified polyester resin.

Production Example 1 of Transparent Toner

[Transparent toner 1] was obtained in the same manner as in Production Example 1 of chromatic toner except that the amount of the [masterbatch 1] charged in the preparation of the oil phase was changed to 0 parts by mass, the amount of the [non-crystalline polyester resin 1] charged in the preparation of the oil phase was changed to 534.2 parts by mass, the amount of the carnauba wax charged in the preparation of the oil phase was changed to 59.9 parts by mass, the amount of the [crystalline polyester resin 1] charged in the preparation of the oil phase was changed to 89.9 parts by mass, and that the amount of the [prepolymer 1] charged in the emulsification was changed to 22.5 parts by mass.

Production Example 2 of Transparent Toner

[Transparent toner 2] was obtained in the same manner as in Production Example 1 of chromatic toner except that the amount of the [non-crystalline polyester resin 1] charged in the preparation of the oil phase was changed to 535.1 parts by mass and that the amount of the [prepolymer 1] charged in the emulsification was changed to 17.7 parts by mass.

Production Example 3 of Transparent Toner

[Transparent toner 3] was obtained in the same manner as in Production Example 1 of chromatic toner except that the amount of the [non-crystalline polyester resin 1] charged in the preparation of the oil phase was changed to 531.5 parts by mass and that the amount of the [prepolymer 1] charged in the emulsification was changed to 28.4 parts by mass.

Production Example 4 of Transparent Toner

[Transparent toner 4] was obtained in the same manner as in Production Example 1 of chromatic toner except that the amount of the [non-crystalline polyester resin 1] charged in the preparation of the oil phase was changed to 519.2 parts by mass and that the amount of the [crystalline polyester resin 1] charged in the preparation of the oil phase was changed to 104.8 parts by mass.

Production Example 5 of Transparent Toner

[Transparent toner 5] was obtained in the same manner as in Production Example 1 of chromatic toner except that the amount of the [non-crystalline polyester resin 1] charged in the preparation of the oil phase was changed to 579.1 parts by mass and that the amount of the [crystalline polyester resin 1] charged in the preparation of the oil phase was changed to 44.9 parts by mass.

Production Example 6 of Transparent Toner

[Transparent toner 6] was obtained in the same manner as in Production Example 1 of chromatic toner except that the amount of the [non-crystalline polyester resin 1] charged in the preparation of the oil phase was changed to 549.1 parts by mass and that the amount of the carnauba wax charged in the preparation of the oil phase was changed to 44.9 parts by mass.

Production Example 7 of Transparent Toner

[Transparent toner 7] was obtained in the same manner as in Production Example 1 of chromatic toner except that the amount of the [non-crystalline polyester resin 1] charged in the preparation of the oil phase was changed to 519.2 parts by mass and that the amount of the carnauba wax charged in the preparation of the oil phase was changed to 74.9 parts by mass.

Production Example 8 of Transparent Toner

[Transparent toner 8] was obtained in the same manner as in Production Example 1 of chromatic toner except that the amount of the [non-crystalline polyester resin 1] charged in the preparation of the oil phase was changed to 525.1 parts by mass, the amount of the carnauba wax charged in the preparation of the oil phase was changed to 72.5 parts by mass, and that the amount of the [prepolymer 1] charged in the emulsification was changed to 10.4 parts by mass.

Production Example 9 of Transparent Toner

[Transparent toner 9] was obtained in the same manner as in Production Example 1 of chromatic toner except that the amount of the [non-crystalline polyester resin 1] charged in the preparation of the oil phase was changed to 528 parts by mass and that the amount of the [prepolymer 1] charged in the emulsification was changed to 36.2 parts by mass.

Production Example 10 of Transparent Toner

[Transparent toner 10] was obtained in the same manner as in Production Example 1 of chromatic toner except that the amount of the [non-crystalline polyester resin 1] charged in the preparation of the oil phase was changed to 590.4 parts by mass and that the amount of the [crystalline polyester resin 1] charged in the preparation of the oil phase was changed to 33.7 parts by mass.

Production Example 11 of Transparent Toner

[Transparent toner 11] was obtained in the same manner as in Production Example 1 of chromatic toner except that the amount of the [non-crystalline polyester resin 1] charged in the preparation of the oil phase was changed to 451.8 parts by mass, the amount of the carnauba wax charged in the preparation of the oil phase was changed to 82.4 parts by mass, and that the amount of the [crystalline polyester resin 1] charged in the preparation of the oil phase was changed to 149.8 parts by mass.

Production Example 12 of Transparent Toner

[Transparent toner 12] was obtained in the same manner as in Production Example 1 of chromatic toner except that the amount of the [non-crystalline polyester resin 1] charged in the preparation of the oil phase was changed to 596.3 parts by mass, the amount of the carnauba wax charged in the preparation of the oil phase was changed to 11.4 parts by mass, the amount of the [crystalline polyester resin 1] charged in the preparation of the oil phase was changed to 76 parts by mass, and that the amount of the [prepolymer 1] charged in the emulsification was changed to 27.8 parts by mass.

Production Example 13 of Transparent Toner

[Transparent toner 13] was obtained in the same manner as in Production Example 1 of chromatic toner except that the amount of the [non-crystalline polyester resin 1] charged in the preparation of the oil phase was changed to 489.3 parts by mass and that the amount of the carnauba wax charged in the preparation of the oil phase was changed to 104.8 parts by mass.

Production Example 14 of Transparent Toner

[Transparent toner 14] was obtained in the same manner as in Production Example 14 of chromatic toner except that the [non-crystalline polyester dispersion liquid 1] was changed to [non-crystalline polyester dispersion liquid 2] prepared in the following manner and that the pigment dispersion liquid was not added.

—Preparation of [Non-Crystalline Polyester Dispersion Liquid 2]—

[Non-crystalline polyester dispersion liquid 2] was prepared in the same manner as in the preparation of the crystalline polyester dispersion liquid 1 except that the [crystalline polyester resin 1] (180 parts by mass) was changed to the [non-crystalline polyester resin 1] (80 parts by mass) and the [non-crystalline polyester resin 2] (100 parts by mass).

Production Example 15 of Transparent Toner

[Transparent toner 15] was obtained in the same manner as in Production Example 15 of chromatic toner except that the carbon black was changed to the [non-crystalline polyester resin 2].

Production Example 16 of Transparent Toner

[Transparent toner 16] was obtained in the same manner as in Production Example 1 of chromatic toner except that the amount of the [non-crystalline polyester resin 1] charged in the preparation of the oil phase was changed to 524 parts by mass and that the amount of the [prepolymer 1] charged in the emulsification was changed to 45 parts by mass.

Production Example 17 of Transparent Toner

[Transparent toner 17] was obtained in the same manner as in Production Example 1 of chromatic toner except that the amount of the [non-crystalline polyester resin 1] charged in the preparation of the oil phase was changed to 621.1 parts by mass, the amount of the [crystalline polyester resin 1] charged in the preparation of the oil phase was changed to 0 parts by mass, and that the amount of the [prepolymer 1] charged in the emulsification was changed to 36.2 parts by mass.

Production Example 18 of Transparent Toner

[Transparent toner 18] was obtained in the same manner as in Production Example 1 of chromatic toner except that the amount of the [non-crystalline polyester resin 1] charged in the preparation of the oil phase was changed to 540 parts by mass, the amount of the [crystalline polyester resin 1] charged in the preparation of the oil phase was changed to 86.8 parts by mass, and that the amount of the [prepolymer 1] charged in the emulsification was changed to 9.6 parts by mass.

Production Example 19 of Transparent Toner

[Transparent toner 19] was obtained in the same manner as in Production Example 1 of chromatic toner except that the amount of the [non-crystalline polyester resin 1] charged in the preparation of the oil phase was changed to 507.8 parts by mass and that the amount of the [prepolymer 1] charged in the emulsification was changed to 80.8 parts by mass.

Production Example 20 of Transparent Toner

[Transparent toner 20] was obtained in the same manner as in Production Example 1 of chromatic toner except that the amount of the [non-crystalline polyester resin 1] charged in the preparation of the oil phase was changed to 590.1 parts by mass and that the amount of the carnauba wax charged in the preparation of the oil phase was changed to 0 parts by mass.

Tables 2-1 and 2-2 present: the amounts of the crystalline polyester resin, the wax serving as a releasing agent, and the prepolymer which were calculated from their charged amounts in Production Examples 1 to 20 of transparent toners; the amount of tetrahydrofuran (THF) insoluble matters measured by the same method as in the chromatic toners; and the volume average particle diameters and the ratios (Dv/Dn) of the transparent toners.

TABLE 2-1

| | Amount of wax (% by mass) | Amount of crystalline polyester resin (% by mass) | Amount of THF insoluble matter (% by mass) | Volume average particle diameter Dv (μm) | Ratio (Dv/Dn) |
|---|---|---|---|---|---|
| Transparent toner 1 | 8 | 12 | 9.2 | 5.0 | 1.14 |
| Transparent toner 2 | 8 | 12 | 7.2 | 5.4 | 1.16 |
| Transparent toner 3 | 8 | 12 | 11.2 | 5.0 | 1.14 |
| Transparent toner 4 | 8 | 14 | 9.0 | 5.8 | 1.18 |
| Transparent toner 5 | 8 | 6 | 9.5 | 4.6 | 1.18 |
| Transparent toner 6 | 6 | 12 | 8.4 | 5.1 | 1.17 |
| Transparent toner 7 | 10 | 12 | 8.8 | 5.2 | 1.15 |
| Transparent toner 8 | 10 | 12 | 4.3 | 4.4 | 1.15 |
| Transparent toner 9 | 8 | 12 | 14.7 | 4.9 | 1.19 |
| Transparent toner 10 | 8 | 4.5 | 9.3 | 5.8 | 1.20 |
| Transparent toner 11 | 11 | 20 | 9.1 | 4.5 | 1.19 |
| Transparent toner 12 | 1.5 | 10 | 11.4 | 5.7 | 1.18 |
| Transparent toner 13 | 14 | 12 | 9.1 | 5.0 | 1.15 |
| Transparent toner 14 | 8 | 12 | 8.2 | 6.2 | 1.23 |
| Transparent toner 15 | 8 | 12 | 7.8 | 7.4 | 1.33 |
| Transparent toner 16 | 8 | 12 | 17.8 | 5.1 | 1.15 |
| Transparent toner 17 | 8 | 0 | 14.5 | 5.3 | 1.16 |
| Transparent toner 18 | 8 | 12 | 4.0 | 4.9 | 1.15 |
| Transparent toner 19 | 8 | 12 | 28.1 | 4.5 | 1.18 |
| Transparent toner 20 | 0 | 12 | 14.4 | 4.8 | 1.16 |

TABLE 2-2

| | Amount of prepolymer charged (parts by mass) | Amount of prepolymer charged (% by mass) |
|---|---|---|
| Transparent toner 1 | 22.5 | 6.0 |
| Transparent toner 2 | 17.7 | 4.5 |
| Transparent toner 3 | 28.4 | 7.5 |
| Transparent toner 4 | 22.5 | 6.0 |
| Transparent toner 5 | 22.5 | 6.0 |
| Transparent toner 6 | 22.5 | 6.0 |
| Transparent toner 7 | 22.5 | 6.0 |
| Transparent toner 8 | 10.4 | 3.0 |
| Transparent toner 9 | 36.2 | 9.5 |
| Transparent toner 10 | 22.5 | 6.0 |
| Transparent toner 11 | 22.5 | 6.0 |
| Transparent toner 12 | 27.8 | 7.4 |
| Transparent toner 13 | 22.5 | 6.0 |
| Transparent toner 14 | — | — |
| Transparent toner 15 | — | — |
| Transparent toner 16 | 45.0 | 11.3 |
| Transparent toner 17 | 36.2 | 9.5 |

TABLE 2-2-continued

| | Amount of prepolymer charged (parts by mass) | Amount of prepolymer charged (% by mass) |
|---|---|---|
| Transparent toner 18 | 9.6 | 2.7 |
| Transparent toner 19 | 80.8 | 18.7 |
| Transparent toner 20 | 22.5 | 6.0 |

*The amount of prepolymer in Table 2-2 is the same as that of the modified polyester resin.

Examples 1 to 19 and Comparative Examples 1 to 8

Toner sets were prepared in accordance with combinations of the chromatic toners and the transparent toners presented in Table 3. Table 3 presents the combinations of the chromatic toners and the transparent toners, and ratios of the THF insoluble matters of the transparent toners to the THF insoluble matters of the chromatic toners.

TABLE 3

| | | Transprent toner | | Chromatic toner | | Ratio of |
|---|---|---|---|---|---|---|
| | Toner set | No. | Amount of THF insoluble matter (% by mass) | No. | Amount of THF insoluble matter (% by mass) | amounts of THF insoluble matters |
| Ex. 1 | Toner set 1 | 1 | 9.2 | 1 | 19.1 | 0.48 |
| Ex. 2 | Toner set 2 | 2 | 7.2 | 2 | 16.6 | 0.43 |
| Ex. 3 | Toner set 3 | 3 | 11.2 | 3 | 20.7 | 0.54 |
| Ex. 4 | Toner set 4 | 4 | 9.0 | 4 | 19.3 | 0.47 |
| Ex. 5 | Toner set 5 | 5 | 9.5 | 5 | 18.6 | 0.51 |
| Ex. 6 | Toner set 6 | 6 | 8.4 | 6 | 18.4 | 0.46 |
| Ex. 7 | Toner set 7 | 7 | 8.8 | 7 | 18.4 | 0.48 |
| Ex. 8 | Toner set 8 | 8 | 4.3 | 8 | 14.0 | 0.31 |
| Ex. 9 | Toner set 9 | 9 | 14.7 | 9 | 22.5 | 0.65 |
| Ex. 10 | Toner set 10 | 10 | 9.3 | 10 | 17.2 | 0.54 |
| Ex. 11 | Toner set 11 | 11 | 9.1 | 11 | 22.1 | 0.41 |
| Ex. 12 | Toner set 12 | 12 | 11.4 | 12 | 19.3 | 0.59 |
| Ex. 13 | Toner set 13 | 13 | 9.1 | 13 | 19.0 | 0.48 |
| Ex. 14 | Toner set 14 | 3 | 11.2 | 2 | 16.6 | 0.67 |
| Ex. 15 | Toner set 15 | 14 | 8.2 | 14 | 18.2 | 0.45 |
| Ex. 16 | Toner set 16 | 15 | 7.8 | 15 | 17.3 | 0.45 |
| Ex. 17 | Toner set 17 | 15 | 7.8 | 21 | 12.2 | 0.64 |
| Ex. 18 | Toner set 18 | 1 | 9.2 | 22 | 24.6 | 0.37 |
| Ex. 19 | Toner set 19 | 3 | 11.2 | 4 | 19.3 | 0.58 |
| Comp. Ex. 1 | Toner set 20 | 9 | 14.7 | 8 | 14.0 | 1.05 |
| Comp. Ex. 2 | Toner set 21 | 16 | 17.8 | 16 | 11.4 | 1.56 |
| Comp. Ex. 3 | Toner set 22 | 17 | 14.5 | 8 | 14.0 | 1.04 |
| Comp. Ex. 4 | Toner set 23 | 9 | 14.7 | 17 | 14.2 | 1.04 |
| Comp. Ex. 5 | Toner set 24 | 9 | 14.7 | 18 | 14.1 | 1.04 |
| Comp. Ex. 6 | Toner set 25 | 18 | 4.0 | 19 | 3.1 | 1.29 |
| Comp. Ex. 7 | Toner set 26 | 19 | 28.1 | 20 | 25.4 | 1.11 |
| Comp. Ex. 8 | Toner set 27 | 20 | 14.4 | 8 | 14.0 | 1.03 |

TABLE 4

| | | Transparent toner | | Chromatic toner | |
|---|---|---|---|---|---|
| | Toner set | No. | Amount of crystalline polyester resin (% by mass) | No. | Amount of crystalline polyester resin (% by mass) |
| Ex. 1 | Toner set 1 | 1 | 12 | 1 | 8 |
| Ex. 2 | Toner set 2 | 2 | 12 | 2 | 8 |
| Ex. 3 | Toner set 3 | 3 | 12 | 3 | 8 |
| Ex. 4 | Toner set 4 | 4 | 14 | 4 | 13 |
| Ex. 5 | Toner set 5 | 5 | 6 | 5 | 5 |
| Ex. 6 | Toner set 6 | 6 | 12 | 6 | 8 |
| Ex. 7 | Toner set 7 | 7 | 12 | 7 | 8 |
| Ex. 8 | Toner set 8 | 8 | 12 | 8 | 8 |
| Ex. 9 | Toner set 9 | 9 | 12 | 9 | 10 |
| Ex. 10 | Toner set 10 | 10 | 4.5 | 10 | 3 |
| Ex. 11 | Toner set 11 | 11 | 20 | 11 | 20 |
| Ex. 12 | Toner set 12 | 12 | 10 | 12 | 6.5 |
| Ex. 13 | Toner set 13 | 13 | 12 | 13 | 8 |
| Ex. 14 | Toner set 14 | 3 | 12 | 2 | 8 |
| Ex. 15 | Toner set 15 | 14 | 12 | 14 | 8 |
| Ex. 16 | Toner set 16 | 15 | 12 | 15 | 8 |
| Ex. 17 | Toner set 17 | 15 | 12 | 21 | 8 |
| Ex. 18 | Toner set 18 | 1 | 12 | 22 | 8 |
| Ex. 19 | Toner set 19 | 3 | 12 | 4 | 13 |
| Comp. Ex. 1 | Toner set 20 | 9 | 12 | 8 | 8 |
| Comp. Ex. 2 | Toner set 21 | 16 | 12 | 16 | 8 |
| Comp. Ex. 3 | Toner set 22 | 17 | 0 | 8 | 8 |
| Comp. Ex. 4 | Toner set 23 | 9 | 12 | 17 | 22 |
| Comp. Ex. 5 | Toner set 24 | 9 | 12 | 18 | 0 |
| Comp. Ex. 6 | Toner set 25 | 18 | 12 | 19 | 8 |
| Comp. Ex. 7 | Toner set 26 | 19 | 12 | 20 | 8 |
| Comp. Ex. 8 | Toner set 27 | 20 | 12 | 8 | 8 |

TABLE 5

| | | Transparent toner | | Chromatic toner | |
|---|---|---|---|---|---|
| | Toner set | No. | Amount of wax (% by mass) | No. | Amount of wax (% by mass) |
| Ex. 1 | Toner set 1 | 1 | 8 | 1 | 6 |
| Ex. 2 | Toner set 2 | 2 | 8 | 2 | 6 |
| Ex. 3 | Toner set 3 | 3 | 8 | 3 | 6 |
| Ex. 4 | Toner set 4 | 4 | 8 | 4 | 6 |
| Ex. 5 | Toner set 5 | 5 | 8 | 5 | 6 |
| Ex. 6 | Toner set 6 | 6 | 6 | 6 | 5 |
| Ex. 7 | Toner set 7 | 7 | 6 | 7 | 8 |
| Ex. 8 | Toner set 8 | 8 | 10 | 8 | 6 |
| Ex. 9 | Toner set 9 | 9 | 8 | 9 | 6 |
| Ex. 10 | Toner set 10 | 10 | 8 | 10 | 6 |
| Ex. 11 | Toner set 11 | 11 | 11 | 11 | 8 |
| Ex. 12 | Toner set 12 | 12 | 1.5 | 12 | 0.5 |
| Ex. 13 | Toner set 13 | 13 | 14 | 13 | 13 |
| Ex. 14 | Toner set 14 | 3 | 8 | 2 | 6 |
| Ex. 15 | Toner set 15 | 14 | 8 | 14 | 6 |
| Ex. 16 | Toner set 16 | 15 | 8 | 15 | 6 |
| Ex. 17 | Toner set 17 | 15 | 8 | 21 | 6 |
| Ex. 18 | Toner set 18 | 1 | 8 | 22 | 6 |
| Ex. 19 | Toner set 19 | 3 | 8 | 4 | 6 |
| Comp. Ex. 1 | Toner set 20 | 9 | 8 | 8 | 6 |
| Comp. Ex. 2 | Toner set 21 | 16 | 8 | 16 | 6 |
| Comp. Ex. 3 | Toner set 22 | 17 | 8 | 8 | 6 |
| Comp. Ex. 4 | Toner set 23 | 9 | 8 | 17 | 6 |
| Comp. Ex. 5 | Toner set 24 | 9 | 8 | 18 | 6 |
| Comp. Ex. 6 | Toner set 25 | 18 | 8 | 19 | 6 |
| Comp. Ex. 7 | Toner set 26 | 19 | 8 | 20 | 6 |
| Comp. Ex. 8 | Toner set 27 | 20 | 0 | 8 | 6 |

<Production Example of Carrier>

A silicone resin (organostraight silicone, product of Shin-Etsu Silicone Co., Ltd.) (100 parts by mass), γ-(2-aminoethyl) aminopropyltrimethoxysilane (5 parts by mass) and carbon black (10 parts by mass) were added to toluene (100 parts by mass). The resultant mixture was dispersed with a homomixer for 20 min to prepare a resin layer-coating liquid.

Next, a fluidized-bed coating apparatus was used to coat the resin layer-coating liquid on the surface of spherical magnetite (1,000 parts by mass) having a volume average particle diameter of 50 μm, whereby a carrier was produced.

<Production of Developer Set>

Each (5 parts by mass) of the transparent toner and the chromatic toner of each of the toner sets was mixed with the carrier (95 parts by mass) using a ball mill to thereby produce two-component developer sets.

The produced two-component developer sets were evaluated for properties in the following manner. The results are presented in Table 4.

<Evaluation of Fixability>

Each of the produced two-component developer sets was evaluated for fixability using an image forming apparatus (IMAGIO 6000RC, product of Ricoh Company, Ltd.) which could print out sixty A4-size paper sheets per minute and was modified so that the temperature of its fixing roller could be variable. This image forming apparatus was adjusted so that solid images of the transparent toner and the chromatic toner of the toner set were formed on transfer paper sheets of plain paper (Type 6200, product of Ricoh Company, Ltd.) and on transfer paper sheets of thick paper (copy paper sheet <135>, product of Ricoh Company, Ltd.) where each of the solid images carried the toner at 1.0 mg/cm$^2$±0.1 mg/cm$^2$. Then, the plain paper was used to measure a hot offset temperature which is a temperature at which no offset occurred. Meanwhile, the thick paper was used to measure a minimum fixable temperature.

—Hot Offset Resistance—

A solid image having a size of 3 cm×8 cm was developed on the above plain paper where the solid image carried each of the transparent toner and the chromatic toner at 1.0 mg/cm$^2$±0.1 mg/cm$^2$, followed by fixing. The hot offset temperature of the chromatic toner was defined as a temperature of the fixing roller at which transfer of color from the fixed solid image to a portion having no image could visually be confirmed. The hot offset resistance of the chromatic toner was evaluated from the hot offset temperature according to the following evaluation criteria. The hot offset temperature of the transparent toner was defined as a temperature of the fixing roller at which transfer of gloss by the transparent toner to the plain paper could visually be confirmed. The hot offset resistance of the transparent toner was evaluated from the hot offset temperature according to the following evaluation criteria.

[Evaluation Criteria of Hot Offset Resistance]

A: The hot offset temperatures of the transparent toner and the chromatic toner were both 175° C. or higher.

B: The hot offset temperature of either the transparent toner or the chromatic toner was 165° C. or higher but lower than 175° C.

C: The hot offset temperature of either the transparent toner or the chromatic toner was lower than 165° C.

—Low-Temperature Fixability—

A solid image was fixed on the above transfer paper sheets of thick paper. The minimum fixable temperature of the chromatic toner was defined as a temperature of the fixing roller at which transfer of color from the fixed solid image to a portion having no image could visually be confirmed. The low-temperature fixability of the chromatic toner was evaluated from the minimum fixable temperature according to the following evaluation criteria. The minimum fixable temperature of the transparent toner was defined as a temperature of the fixing roller at which transfer of gloss by the transparent toner to the transfer paper sheets could visually be confirmed. The low-temperature fixability of the transparent toner was evaluated from the minimum fixable temperature according to the following evaluation criteria.

[Evaluation Criteria of Hot Offset Resistance]

A: The minimum fixable temperatures of the transparent toner and the chromatic toner were both lower than 120° C.

B: The minimum fixable temperature of either the transparent toner or the chromatic toner was 120° C. or higher but lower than 130° C.

C: The minimum fixable temperature of either the transparent toner or the chromatic toner was 130° C. or higher.

<Evaluation of Glossiness>

An image was formed using each toner set as follows. Specifically, a solid image of the chromatic toner was formed on a sheet of POD gloss coat paper (basis weight: 128 g/m$^2$, product of Oji Paper Co., Ltd.) where the solid image carried the chromatic toner at 0.4 mg/cm$^2$. Then, a solid image of the transparent toner was formed on the solid image of the chromatic toner where the solid image carried the transparent toner at 0.4 mg/cm$^2$. The formed image was fixed at a fixing temperature of 180° C. and a nip width of 20 mm, and then measured for 60-degree glossiness at a light incident angle of 60°. Note that, the average thickness of the transparent toner layer after the fixing was found to be 6.2 μm.

The glossiness was determined as an average glossiness using a gloss meter (product of NIPPON DENSHOKU INDUSTRIES Co., LTD, GLOSS METER VGS-1D). The average glossiness was determined by averaging 60-degree glossinesses measured at any 10 locations on the image at a light incident angle of 60°, and evaluated according to the following evaluation criteria.

[Evaluation Criteria of Glossiness]

A: The average glossiness was 80° or higher.

B: The average glossiness was 50° or higher but lower than 80°.

C: The average glossiness was lower than 50°.

Next, a solid image was formed using each chromatic toner on a sheet of POD gloss coat paper (basis weight: 128 g/m$^2$, product of Oji Paper Co., Ltd.) where the solid image carried the chromatic toner at 0.4 mg/cm$^2$. The formed image was fixed at a fixing temperature of 180° C. and a nip width of 20 mm, and then measured for 60-degree glossiness in the same manner as described above, to thereby determine an average glossiness. The difference between the average glossiness of the solid image of the chromatic toner and the average glossiness of the fixed image, where the solid image of the transparent toner was formed on the solid image of the chromatic toner, was evaluated according to the following evaluation criteria.

[Evaluation Criteria of Difference in Glossiness]

A: The difference between the average glossinesses was 60° or higher.

B: The difference between the average glossinesses was 40° or higher but lower than 60°.

C: The difference between the average glossinesses was lower than 40°.

<Overall Evaluation>

Overall evaluation was made according to the following criteria.

A: A in all the items.

B: There is at least one B but is no C.

C: There is at least one C.

TABLE 4

| | | | | Fixability | | |
|---|---|---|---|---|---|---|
| | Toner set | Avg. glossiness | Difference in glossiness | Hot offset resistance | Low-temp. fixability | Overall evaluation |
| Ex. 1 | Toner set 1 | A | A | A | A | A |
| Ex. 2 | Toner set 2 | A | A | A | A | A |
| Ex. 3 | Toner set 3 | A | A | A | A | A |
| Ex. 4 | Toner set 4 | A | A | A | A | A |
| Ex. 5 | Toner set 5 | A | A | A | A | A |
| Ex. 6 | Toner set 6 | A | A | A | A | A |
| Ex. 7 | Toner set 7 | A | A | A | A | A |
| Ex. 8 | Toner set 8 | A | A | B | A | B |
| Ex. 9 | Toner set 9 | B | B | A | B | B |
| Ex. 10 | Toner set 10 | B | A | A | B | B |
| Ex. 11 | Toner set 11 | A | A | B | A | B |
| Ex. 12 | Toner set 12 | A | B | B | B | B |
| Ex. 13 | Toner set 13 | A | A | A | B | B |
| Ex. 14 | Toner set 14 | A | B | B | B | B |
| Ex. 15 | Toner set 15 | A | A | B | B | B |
| Ex. 16 | Toner set 16 | A | A | B | A | B |
| Ex. 17 | Toner set 17 | A | B | B | A | B |
| Ex. 18 | Toner set 18 | B | A | A | B | B |
| Ex. 19 | Toner set 19 | A | B | A | A | B |
| Comp. Ex. 1 | Toner set 20 | B | C | B | A | C |
| Comp. Ex. 2 | Toner set 21 | C | C | A | A | C |
| Comp. Ex. 3 | Toner set 22 | C | C | A | A | C |
| Comp. Ex. 4 | Toner set 23 | B | C | C | A | C |
| Comp. Ex. 5 | Toner set 24 | B | C | A | C | C |
| Comp. Ex. 6 | Toner set 25 | A | C | C | A | C |
| Comp. Ex. 7 | Toner set 26 | C | C | A | C | C |
| Comp. Ex. 8 | Toner set 27 | B | C | C | A | C |

As is clear from Table 4, Examples 1 to 19 was found to provide the toner sets, each containing the transparent toner and the chromatic toner, which were excellent in hot offset resistance, able to ensure a great difference in glossiness, and exhibited both high average glossiness and satisfactory fixability.

Aspects of the present invention are, for example, as follows.

<1> A toner set, including:

at least one chromatic toner containing a colorant; and a transparent toner containing no colorant, wherein the chromatic toner and the transparent toner each include a releasing agent and a binder resin, and wherein an amount of a tetrahydrofuran insoluble matter in the transparent toner is smaller than an amount of a tetrahydrofuran insoluble matter in the chromatic toner.

<2> The toner set according to <1>, wherein the amount of the tetrahydrofuran insoluble matter in the chromatic toner is 14% by mass or more but 23% by mass or less, and wherein the amount of the tetrahydrofuran insoluble matter in the transparent toner is 5% by mass or more but less than 14% by mass.

<3> The toner set according to <1> or <2>, wherein a ratio of the amount of the tetrahydrofuran insoluble matter in the transparent toner to the amount of the tetrahydrofuran insoluble matter in the chromatic toner is 0.65 or less.

<4> The toner set according to any one of <1> to <3>, wherein the chromatic toner and the transparent toner each include a modified polyester resin, wherein an amount of the modified polyester resin in the transparent toner is 15% by mass or less, and wherein an amount of the modified polyester resin in the chromatic toner is 5% by mass or more.

<5> The toner set according to any one of <1> to <4>, wherein the chromatic toner and the transparent toner each include a crystalline polyester resin, and wherein an amount of the crystalline polyester resin in the transparent toner is greater than an amount of the crystalline polyester resin in chromatic toner.

<6> The toner set according to <5>, wherein the amount of the crystalline polyester resin in the transparent toner is 5% by mass or more.

<7> The toner set according to any one of <1> to <6>, wherein an amount of the releasing agent in the transparent toner is greater than an amount of the releasing agent in the chromatic toner.

<8> The toner set according to <7>, wherein the amount of the releasing agent in the transparent toner is 2% by mass to 13% by mass.

<9> The toner set according to any one of <1> to <8>, wherein the chromatic toner and the transparent toner each are a toner obtained by removing an organic solvent from an O/W dispersion liquid where an oil phase containing the binder resin and the releasing agent in the organic solvent is dispersed in an aqueous medium.

<10> The toner set according to any one of <1> to <9>, wherein the transparent toner has a volume average particle diameter of 3 μm to 7 μm, and a ratio of Dv/Dn is 1.3 or less, where Dv is the volume average particle diameter of the transparent toner and Dn is a number average particle diameter of the transparent toner.

<11> A developer set, including:

the toner set according to any one of <1> to <10>; and carriers.

<12> An image forming apparatus, including:

a latent electrostatic image bearing member;

a charging unit configured to charge a surface of the latent electrostatic image bearing member;

an exposing unit configured to expose the charged surface of the latent electrostatic image bearing member to light to form a latent electrostatic image;

a developing unit configured to develop the latent electrostatic image with a toner set to form a visible image;

a transfer unit configured to transfer the visible image onto a recording medium; and a fixing unit configured to fix the transferred visible image on the recording medium, wherein the toner set is the toner set according to any one of <1> to <10>.

<13> The image forming apparatus according to <12>, wherein an uppermost layer of the transferred visible image on the recording medium is a layer of the transparent toner, and wherein an average thickness of the layer of the transparent toner is 1 μm to 15 μm after fixing of the transferred visible image.

This application claims priority to Japanese application No. 2012-119419, filed on May 25, 2012 and incorporated herein by reference.

What is claimed is:

1. A toner set, comprising:

at least one chromatic toner comprising a colorant; and a transparent toner comprising no colorant, wherein the chromatic toner and the transparent toner each comprise a releasing agent and a binder resin, and wherein an amount of a tetrahydrofuran insoluble matter in the transparent toner is smaller than an amount of a tetrahydrofuran insoluble matter in the chromatic toner, and wherein the chromatic toner and the transparent toner each comprise a crystalline polyester resin, an amount of the crystalline polyester resin in the transparent toner is greater than an amount of the crystalline polyester resin in the chromatic toner, and the amount of the crystalline polyester resin in the transparent toner is 5% by mass or more.

2. The toner set according to claim 1, wherein the amount of the tetrahydrofuran insoluble matter in the chromatic toner is 14% by mass or more but 23% by mass or less, and wherein the amount of the tetrahydrofuran insoluble matter in the transparent toner is 5% by mass or more but less than 14% by mass.

3. The toner set according to claim 1, wherein a ratio of the amount of the tetrahydrofuran insoluble matter in the transparent toner to the amount of the tetrahydrofuran insoluble matter in the chromatic toner is 0.65 or less.

4. A toner set, comprising:

at least one chromatic toner comprising a colorant; and a transparent toner comprising no colorant, wherein the chromatic toner and the transparent toner each comprise a releasing agent and a binder resin, and an amount of a tetrahydrofuran insoluble matter in the transparent toner is smaller than an amount of a tetrahydrofuran insoluble matter in the chromatic toner, and wherein the chromatic toner and the transparent toner each comprise a modified polyester resin, an amount of the modified polyester resin in the transparent toner is 15% by mass or less, and an amount of the modified polyester resin in the chromatic toner is 5% by mass or more.

5. The toner set according to claim 1, wherein an amount of the releasing agent in the transparent toner is greater than an amount of the releasing agent in the chromatic toner.

6. The toner set according to claim 5, wherein the amount of the releasing agent in the transparent toner is 2% by mass to 13% by mass.

7. The toner set according to claim 1, wherein the chromatic toner and the transparent toner each are a toner obtained by removing an organic solvent from an O/W dispersion liquid where an oil phase comprising the binder resin and the releasing agent in the organic solvent is dispersed in an aqueous medium.

8. The toner set according to claim 1, wherein the transparent toner has a volume average particle diameter of 3 μm to 7 μm, and a ratio of Dv/Dn is 1.3 or less, where Dv is the volume average particle diameter of the transparent toner and Dn is a number average particle diameter of the transparent toner.

9. A developer set, comprising:

a toner set; and carriers, wherein the toner set comprises:

at least one chromatic toner comprising a colorant; and a transparent toner comprising no colorant, wherein the chromatic toner and the transparent toner each comprise a releasing agent and a binder resin, and wherein an amount of a tetrahydrofuran insoluble matter in the transparent toner is smaller than an amount of a tetrahydrofuran insoluble matter in the chromatic toner, and wherein the chromatic toner and the transparent toner each comprise a crystalline polyester resin, an amount of the crystalline polyester resin in the transparent toner is greater than an amount of the crystalline polyester resin in the chromatic toner, and the amount of the crystalline polyester resin in the transparent toner is 5% by mass or more.

* * * * *